US008257158B2

(12) United States Patent
Suda

(10) Patent No.: US 8,257,158 B2
(45) Date of Patent: Sep. 4, 2012

(54) GAMING MACHINE WITH VARIOUS GAME STYLES

(75) Inventor: Satoshi Suda, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 1034 days.

(21) Appl. No.: 11/978,428

(22) Filed: Oct. 29, 2007

(65) Prior Publication Data

US 2009/0111565 A1 Apr. 30, 2009

(51) Int. Cl.
*A63F 9/24* (2006.01)

(52) U.S. Cl. ..... 463/16; 463/20

(58) Field of Classification Search ..... 463/16, 463/20

See application file for complete search history.

(56) References Cited

U.S. PATENT DOCUMENTS

| | | | | |
|---|---|---|---|---|
| 4,861,041 | A | 8/1989 | Jones et al. | |
| 5,042,818 | A * | 8/1991 | Weingardt | 463/13 |
| 6,155,925 | A * | 12/2000 | Giobbi et al. | 463/20 |
| 6,776,714 | B2 | 8/2004 | Ungaro | |
| 7,029,395 | B1 * | 4/2006 | Baerlocher | 463/20 |
| 2002/0160826 | A1 * | 10/2002 | Gomez et al. | 463/16 |
| 2003/0216169 | A1 * | 11/2003 | Walker et al. | 463/25 |
| 2005/0130737 | A1 * | 6/2005 | Englman et al. | 463/25 |
| 2006/0157927 | A1 | 7/2006 | O'Halloran et al. | |
| 2006/0247029 | A1 | 11/2006 | Walker et al. | |
| 2006/0287062 | A1 | 12/2006 | Okada | |
| 2007/0049372 | A1 | 3/2007 | Olivas et al. | |

FOREIGN PATENT DOCUMENTS

| | | | |
|---|---|---|---|
| AU | 2007/209798 | A1 | 3/2008 |
| WO | WO 02/38234 | A1 | 5/2002 |

OTHER PUBLICATIONS

Examiner's first report on Australian Patent Application No. 2008229935, dispatched date Jun. 18, 2010, IP Australia.
Examiner's second report on Australian Patent Application No. 2008229935, dispatched date Feb. 14, 2011, IP Australia.

* cited by examiner

*Primary Examiner* — Omkar Deodhar
(74) *Attorney, Agent, or Firm* — Masuvalley & Partners

(57) ABSTRACT

The present invention relates to a gaming machine which has a display screen or physical reel mechanism and one or a plurality of types of features provided on said display screen, wherein said one or more features are activated when an extra bet wager is made separately of the initial wager amount, and can be adjusted independently. Also, the gaming machine of the present invention has one or more bonus games, and a player can change a bet amount at any time during the course of said bonus game.

4 Claims, 27 Drawing Sheets

GAMING MACHINE WITH VARIOUS GAME STYLES

TECHNICAL FIELD

The present invention relates to a gaming machine having various game styles. For example, the gaming machine according to the present invention allows a player to change a bet amount, and offers various game rules to the player according to the change of bet amount. Further, the gaming machine according to the present invention comprises a plurality of gaming machines which allows a plurality of players to play simultaneously.

BACKGROUND OF INVENTION

Conventionally, a gaming machine which has a plurality of bonus stages, is known, and players are able to enjoy various types of bonus stages when a bonus game is started. Although each player generally has their own preference, however, the conventional gaming machines could not provide a bonus game style according to each of those players' preferences and also provide the same bonus game style to all the players. For this reason, a gaming machine which allows a player to select a bonus stage and to upgrade a bonus stage in his/her preference, has been desired.

Also, conventionally, in a so called progressive game, where plural game machines are connected to each other, a prize amount increases according to each player's game progress at a bonus game, and a player who draws the bonus is awarded the prize, is known. However, in such a case, each player independently plays the game, but a machine which allows a plurality of players to enjoy a slot game as a team play is unknown. Therefore, a plurality of gaming machines which allows a plurality of players to enjoy a slot game as a team play, has been desired.

SUMMARY OF THE INVENTION

An aspect of the present invention is a gaming machine which has a display screen or a physical reel mechanism and one or a plurality of types of features provided on said display screen, wherein said one or more features are activated when an extra bet wager is made separately of the initial wager amount, and can be adjusted independently.

Generally, players in casinos feel pleasure in obtaining a large amount of money in one game. By configuring as described above, a player can activate a number of features. As a result, the player raises hope for a bonus, and also the player can play excitedly while having a thought that he or she may be able to get a large prize.

The gaming machine may have a free game having at least one time to play the game, and when a player changes the bet amount the number of times to play said free game changes according to said bet amount.

The gaming machine may have a bonus game having at least one progressives, and when a player changes a bet amount, the possibility for the player to win the progressive may be changed according to changes of the bet amount.

The gaming machine may have a bonus game including a special symbol, and when a player changes a bet amount, the function of the special symbol may be changed according to changes of the bet amount.

The gaming machine may have a bonus game including a special symbol, and when a player changes a bet amount, the possibly of appearance of the special symbol may be changed according to a change of the bet amount.

By configuring as described above, the appearance ratio of the special symbol in a bonus game increases.

As a result, it is easier for special symbols to appear in a bonus game, thereby the prize amount increases and the number of times to obtain a bonus increases.

In this way, players who enjoy such play style can further enjoy the game, and the players may be attracted.

The payout ratio to a player against the feature may be changed according to a change of the bet amount.

Generally, players in casinos feel pleasure in obtaining a large amount of money in one game. By configuring as described above, the player can obtain a large amount of money in a bonus game even he or she is playing with a low amount in a primary game, thereby the player can be satisfied.

Also, a player who is playing with a low amount in a primary game will not feel regret because the play style can be changed to one that allows the player to obtain a large amount in the bonus game.

The possibility for the feature to be triggered may be changed according to a change of the bet amount.

The number of the features to be activated may be changed according to a change of the bet amount.

By configuring as described above, the number of active features to appear in a primary game or a bonus game can be increased.

As a result, it is easier to transfer from a primary game to a bonus game, and also advantages to a player such as an increase of the payout amount to a player, increases.

In this way, players who enjoy such play style can further enjoy the game, and the players may be attracted.

A player can select at least one or more types of features, and the plurality types of features that can be selected may be changed according to a change of the bet amount.

Each player can enjoy a game with a style that is close to his or her preference (such as a bonus game with a large amount of winnings in one game, or a bonus game with a high possibility of winning) by configuring a game machine as described above which allows the player to select one or more features from the plurality of features. Also, it can provide variety, thus the player will not be bored by playing repeatedly and it provides a more exciting gaming machine compared to conventional ones. In addition, the player can select setting details of the game, thereby the player can participate the game more deeply.

A player can select one or more types of features from the plurality of types, and the number of features that can be selected by the player may be changed according to a change of the bet amount.

By configuring as described above, the number of features to appear can be changed, thereby expanding the range of choices for the player. As a result, the bonus game will be more exciting.

The number of features to be activated may be changed according to a change of the bet amount.

Also, the present invention is a game machine comprising a display screen or physical reel mechanism, wherein the gaming machine has at least one bonus game, and a player can change a bet amount at any time during the course of said bonus game.

The rule of the bonus game may be changed according to a change of the bet amount.

The player can enjoy a game with a style that is close to his or her preference, such as a game with a large amount of winning amounts in one game, or a game with a high possibility of a triggering feature, by configuring a game machine as described above which allows a change to the game rules.

The bonus game has a pay table, and the pay table may be changed according to a change of the bet amount.

The payout ratio of the bonus game to a player may be changed according to a change of the bet amount.

The bonus game has at least one or more progressives, and the possibility for a player to win the progressive may be changed according to a change of the bet amount.

Also, the present invention is a gaming machine which has a display screen and one or a plurality of types of features provided on said display screen, wherein a player may change a bet amount, and the game rules change according to the change.

The game includes one or a plurality times of a free game, and the number of times of the free game can be changed according to a change of the bet amount.

The game has a special symbol, and the function of the special symbol may be changed according to a change of the bet amount.

The game has a special symbol, and the possibly of the appearance of the special symbol may be changed according to a change of the bet amount.

The game has a bonus game which has a pay table, and the pay table may be changed according to a change of the bet amount.

The game has a bonus game and at least one or more progressives, and the possibility for a player to win the progressives may be changed according to a change of the bet amount.

Further, the present invention is a gaming machine wherein a plurality of gaming machines are connected to each other, each gaming machine has a display screen and one or a plurality of types of features are provided on the display screen, and the play result of at least one or more gaming machines out of the plurality of gaming machines affect the operation of other gaming machines other than the gaming machine.

In conventional gaming machines, players play individually. By configuring as described above, other players can move on to a bonus game when one or more players out of a plurality of players moves on to a bonus game from a primary game. Therefore, it builds a sense of fellowship among payers and enables a gaming machine as a team play. Also, a certain player can start a bonus game even when he or she did not draw the bonus game, thereby the player can feel very lucky.

The gaming machine may be configured such that the plurality of players belongs to the plurality of gaming machines and may compete with each other.

The gaming machine may be configured such that the plurality of players belongs to the plurality of gaming machines to cooperate with each other.

The gaming machine may be configured such that the plurality of players belongs to the plurality of gaming machines to obtain the same play result.

By configuring as described above, the player who did not obtain a large amount of money in the bonus game out of the plurality of players may also be given the larger amount than that which the player actually obtained. In this way, it builds a sense of supporting other players among each player, thus each player enjoys the gaming machine as a team play because a sense of fellowship is built among players. And, the players who did not draw a large amount can also obtain more prize amounts, thereby making the players feel very lucky.

The plurality of players belonging to the plurality of gaming machines may obtain play results different from each other.

By configuring as described above, relative merits can be determined for prize amounts among the plurality of players who played the bonus game. In this way, a large amount of money can be paid out to a player who won a large prize and a small amount can be paid out to a player who did not. Even in this case, all of the plurality of players can start the bonus game, thereby players may feel a sense of fellowship among each other and enjoy the gaming machine as a team play.

A selection may be made as to whether a play result of at least one or more gaming machines out of the plurality of gaming machines will affect the operation of other gaming machines or not.

By configuring as described above, each player can arbitrarily select as to play with another player or to play individually, thus providing a game mode that matches the player's preference.

A player who won the right to play continuously based on the play result of the gaming machine may continuously play the game.

The display screen of each game machine may display the operation of the plurality of players.

By configuring as described above, each player can check play conditions of other players while playing, and the players can easily play by competing against or cooperating with each other.

DETAILED DESCRIPTION OF THE INVENTION

The detail of present invention is hereinafter explained, however, the present invention is not limited to this.

Figure 1:
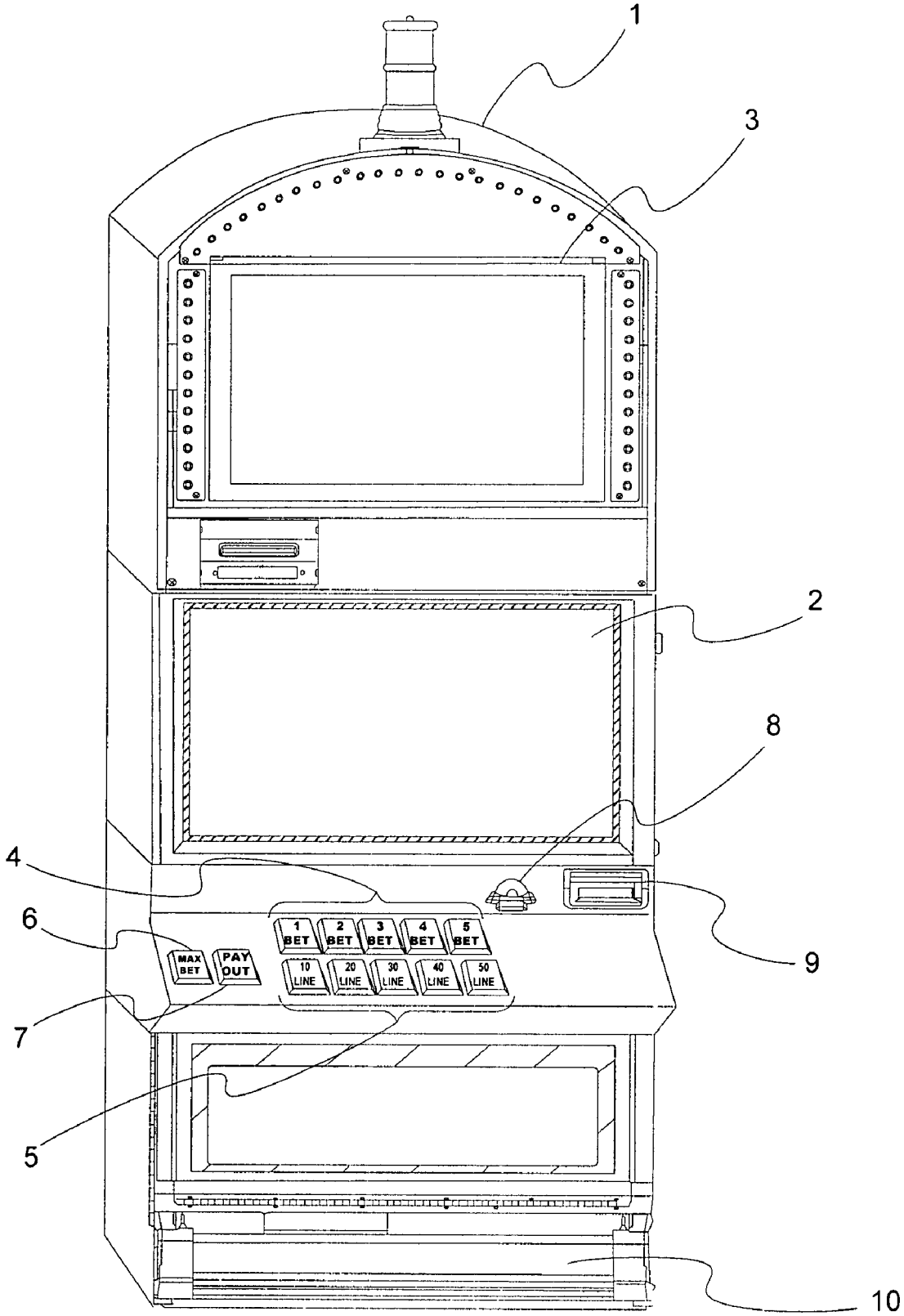
FIG. 1 shows a perspective view of an example of a gaming machine according to the present invention.

FIG. 1 is a perspective view showing an example of a gaming machine according to the present invention. As shown in FIG. 1, a gaming machine 1 has a display screen 2 and 3. A bet switch 4, a multi-line switch 5, a max bet switch 6, a payout switch 7, coin slot 8, and a bill slot 9 are provided right below the display screen 2. The bet switch 4 has five switches, 1 bet through 5 bet. The multi-line switch 5 has five switches 10 line through 50 line. Also, a coin payout slot 10 is provided on the lower right side of the gaming machine 1.

The display screen 2 displays a plurality of reels to play a primary game or a bonus game, and a plurality of features in different types displayed on the reels. The display screen 2 shows a display for a player to choose a type of bonus game to play, a display for a player to select a feature, and a display for a player to play a bonus game. The display screen 3 shows a progressive screen displaying the amount that a player can obtain in a bonus game. Also, the display screens 2 and 3 may display presentations according to a slot game progress or credit input to the game machine by a player. Also, the contents to be displayed on the display screens 2 or 3 described above may be displayed on the display screen 2 or the display screen 3.

The bet switch 4 is to input a bet amount against the slot game. A player can input the bet amount from 1 bet to 5 bet for a slot game using bet switch 4. The multi-line switch 5 is to select lines in order to line up features on the plurality of reels. The player can choose 10 lines each from 10 lines to 50 lines by using the multi-line switch 5. The number of bet switch 4 and the multi-line switch 5 is not limited to five each. For example, there may be a switch for 10 bet or a switch to choose 100 lines.

The max bet switch 6 is to input the maximum bet amount that can be bet on one slot game, and further to select maximum lines. The payout switch 7 is to refund a player with the amount credited to the gaming machine. The coin slot 8 is a hole for a player to credit coins in the gaming machine. The bill slot 9 is to insert a bill or prepaid card into the gaming machine, or to refund the amount credited. The coin payout slot 10 is to refund the amount credited to a gaming machine.

The components provided to the gaming machine according to the present invention are not limited to those described above For example, a lighting device can be provided to illuminate a gaming machine with one or more colors when a player proceeds to a bonus game display or a feature selection display. A device may be provided to vibrate the entire game machine or to output sound when a player proceeded to a bonus game display or a feature selection display. There may be three or more display screens. A switch to re-select the same bet and lines from previous games may be provided. Also, instead of having reels, pictures of reels may only be displayed on the display screen.

Figure 2:
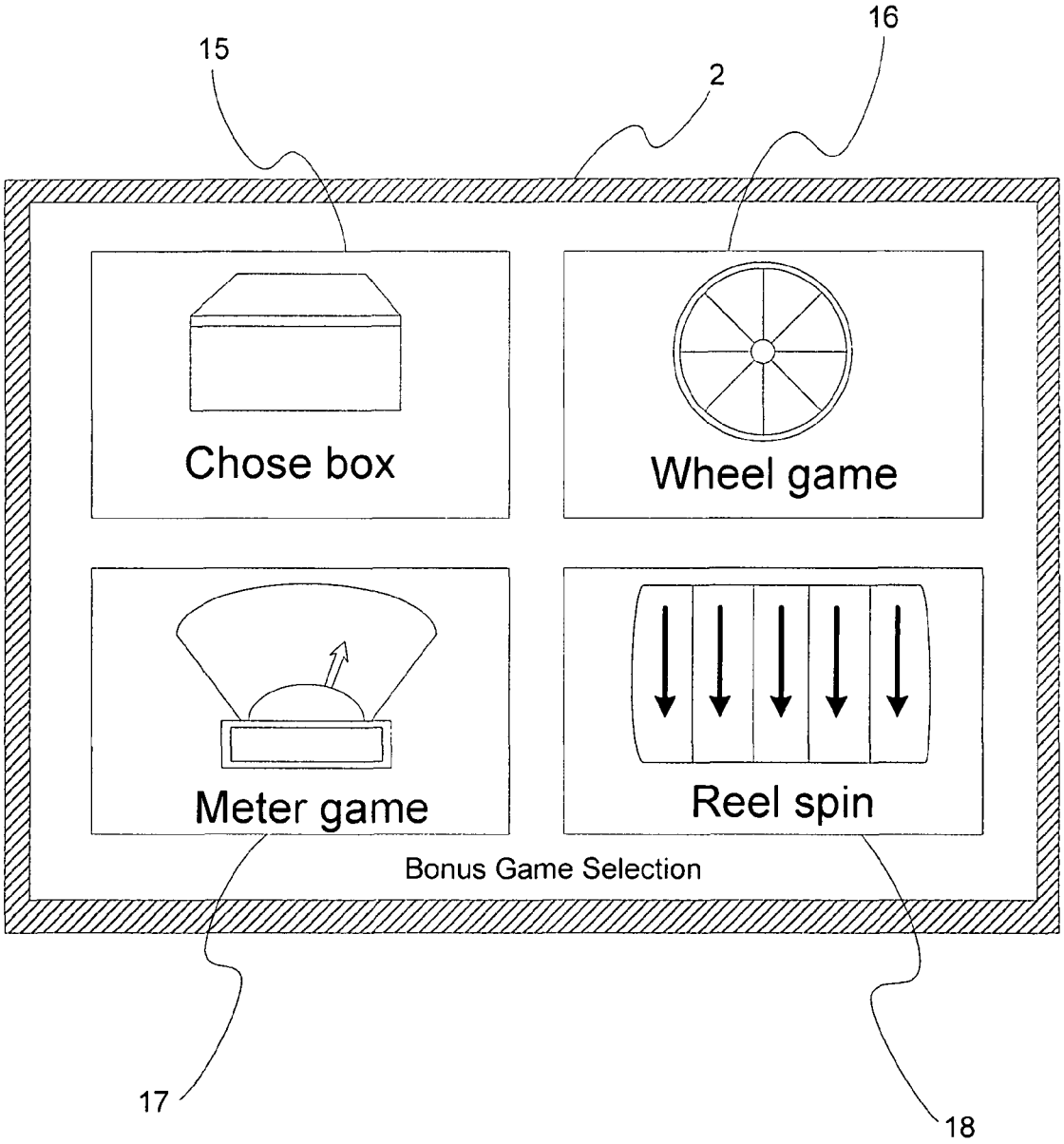
FIG. 2 shows an example of a display at a bonus game selection on a display screen according to the present invention.

The gaming machine which is capable of providing features is hereinafter explained in detail. FIG. 2 shows an example of display shown on the display screen according to the present invention at the selection of a bonus game. A player selects a type of bonus game to be played during the game before staring a primary game. Bonus games of a choose box 15, a wheel game 16, a meter game 17 and a reel spin 18 are displayed on the display screen 2.

The number of bonus games is not limited to four described above and it may be five or more, or three or less. Also, one bonus game may consist of a plurality of stages. The types of bonus game is also not limited specifically. For example, a plurality of buildings with prize amounts shown on the bottom of the display screen and a bombing plane is shown on top of the display screen. The bombing plane is flying and new buildings are shown one after another. A bonus game may be such that the bombing plane drops bombs according to a player's instruction timing to destroy the buildings and obtain prize money. The timing of selecting a bonus game is not limited to before starting the primary game and it may be at any time. For example, it may be selected before the bonus game. Also, the bonus game selection screen may have more displays than those described above. For example, a display to continually provide motion pictures while a player selects a bonus game may be provided.

Figure 3:
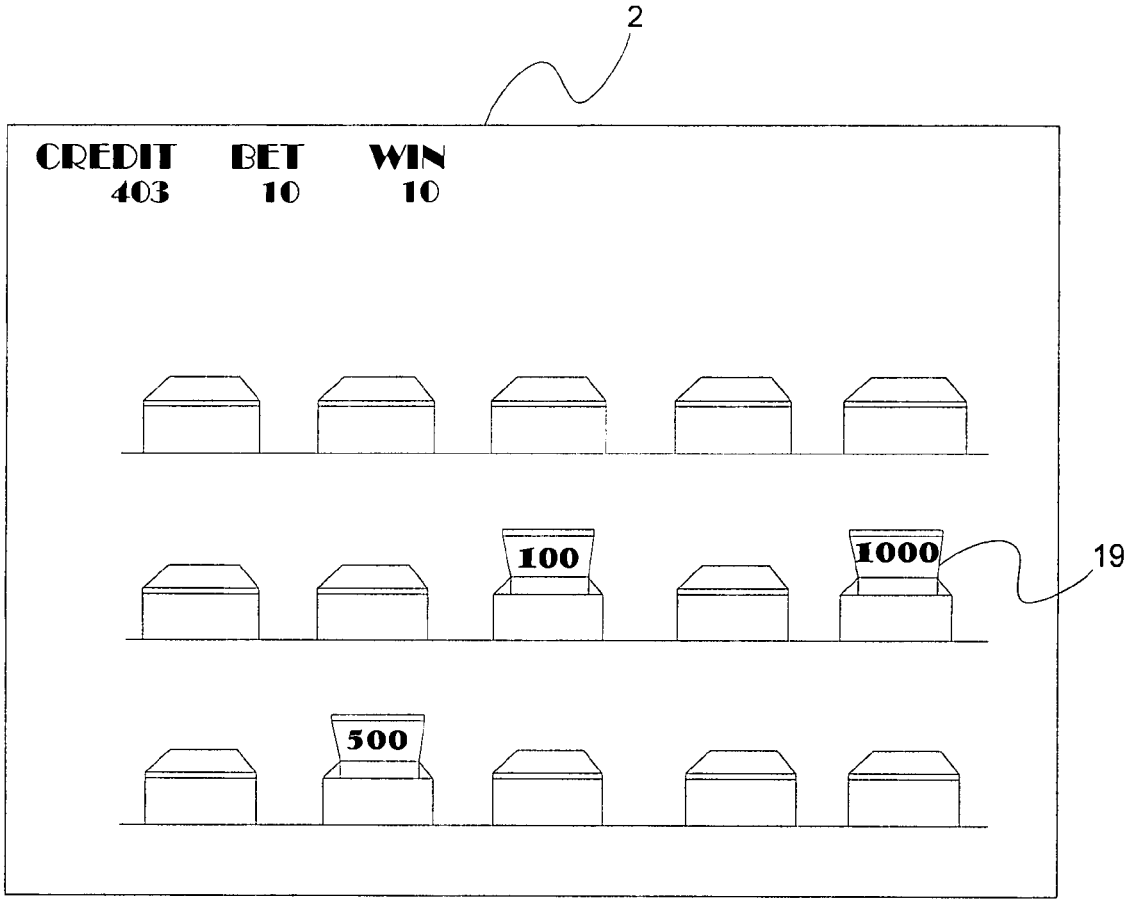
FIG. 3 shows a display screen showing a choose box, that is, a bonus game.

FIG. 3 shows a display screen showing choose box 15, that is, a bonus game. In the choose box 15, first a plurality of boxes are shown on the display screen 2. The boxes have an amount display 19 to be paid out to a player. The player selects a specific number of boxes out of those boxes. The selected boxes open and the player can obtain the total amount opened.

The choose box game is not limited to this, and it may be in a different form. For example, instead of a box, a flower bed may be used and a flower with a prize amount blooms when a player selects. The shape of the box may be a triangle or a star. Also, the number of boxes to be selected by the player may be any number, and it may be three or five. Also, a display to boost the game presentation, such as a fire work, may be provided.

Figure 4:
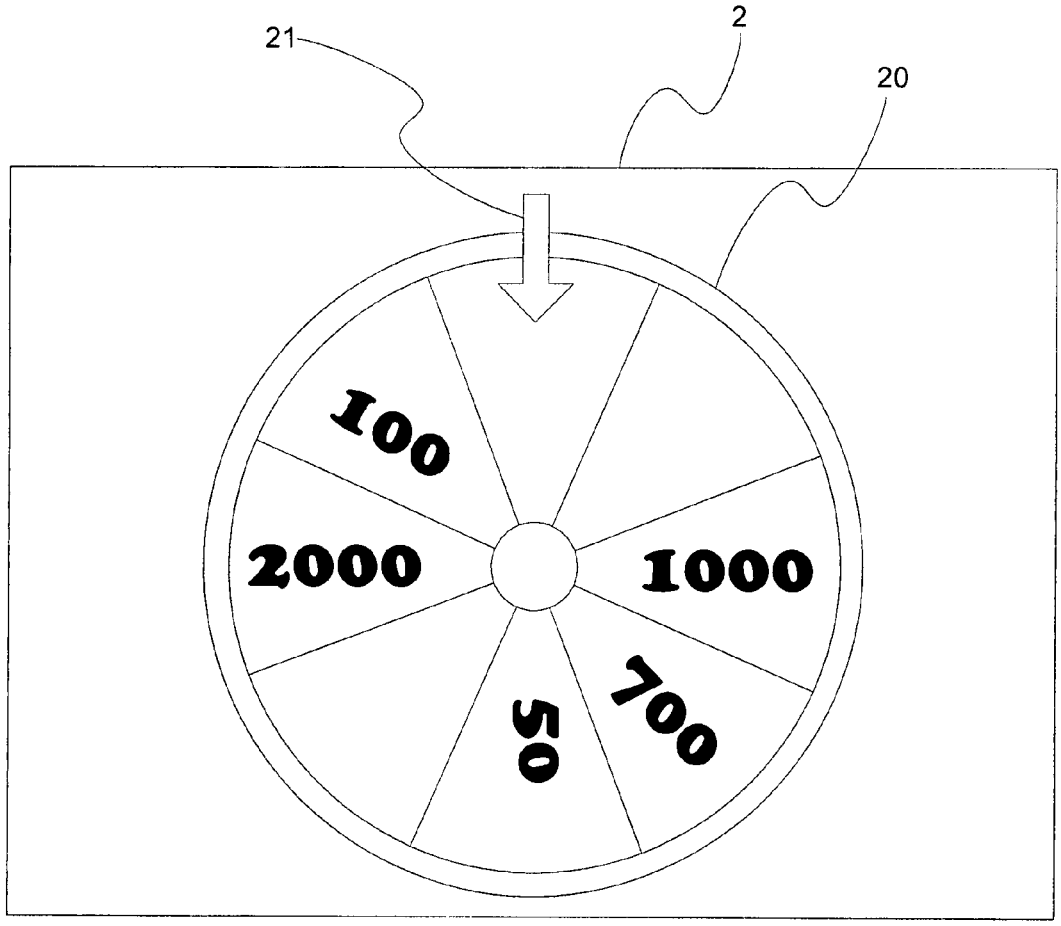
FIG. 4 shows a display screen of a wheel game which is a bonus game.

FIG. 4 shows a display screen of wheel game 16 that is a bonus game. In the wheel game 16, first a wheel 20 that spins and a fixed arrow 21 are displayed on the display screen 2. The wheel 20 has a plurality of columns, and the arrow 21 is provided to point to each section of the spinning wheel 20. Each section on wheel 20 shows the prize amount that can be obtained by a player. When the player starts the wheel game, the wheel 20 spins and the player instructs when to stop spinning, the wheel 20 stops and the fixed arrow 21 points to a specific section on the wheel 20. The player can obtain the prize amount shown on the wheel 20 section.

The wheel game is not limited to this, and it may be in a different form. For example, the number of wheels or arrows may be in any number, and it may be two or three. The number of sections on the wheel may be in any number, and it may be six or ten. Also, a display to boost the game presentation, such as spinning colorful umbrellas, may be provided.

Figure 5:
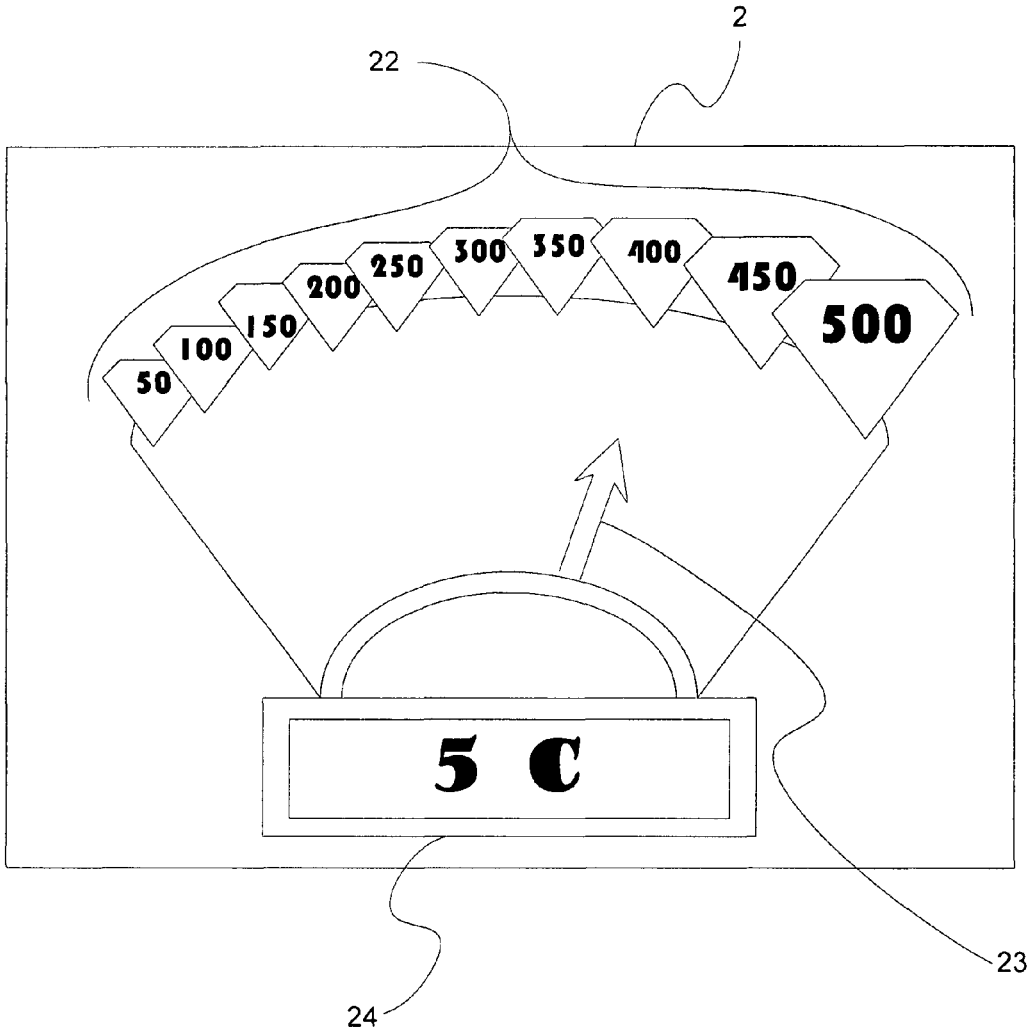
FIG. 5 shows a display screen of a meter game which is a bonus game.

FIG. 5 shows a display screen of a meter game 17 that is a bonus game. In the meter game 17, first, a prize amount display 22, an arrow 23 and a player's bet amount display 24 are shown on the display screen 2. The arrow 23 moves to point in the prize amount display 22. The arrow 23 starts to move when a player instructs it to start, the arrow 23 points any one of the prize amount display 22 and stops when the player instructs it to stop. The player can obtain the amount that is pointed to by the stopped arrow 23.

The meter game is not limited to this, and it may be in a different form. For example, the number of meter games or arrows may be in any number, and it may be two or three. The number of prize amount display on the meter may be in any number and it may be eight or twelve. The shape of the arrow may be a pointing finger. Also, a display to boost the game presentation, such as colorful flowers blooming, may be provided.

Figure 6:
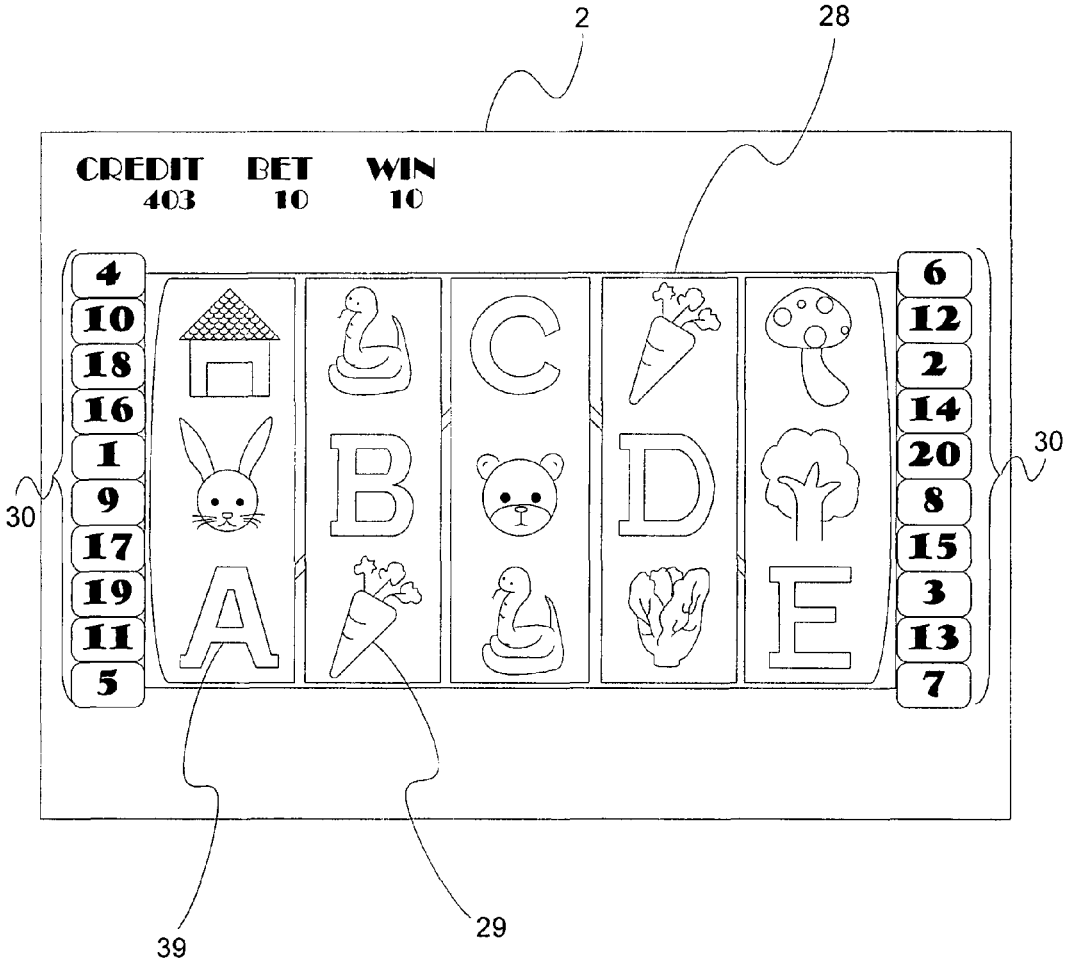
FIG. 6 shows a display screen of a reel game which is a bonus game.

FIG. 6 shows a display screen showing a reel spin 18, that is, a bonus game. In the reel spin 18, a plurality of reels 28, a normal feature 29, a feature 39, and a line number 30 are shown in the display screen 2. The feature 39 refers to a symbol to start a game other than a primary game, such as a bonus game, a free game, or a progressive game (same in this specification). Also, the normal feature 29 refers to other features except for the feature 39 (same in this specification). As shown in the figure, the normal feature 29 has different types (same in following figures). The line number 30 indicates a specific line from a plurality of lines connecting a plurality of reels (same in following figures). First, the reels spin when a player instructs a spin of the reels and the feature stops at a predetermined position. At this time, the player can obtain a prize amount when the features are aligned on the selected line.

The reel spin game is not limited to this, and it may be in different forms. For example, the type of features may be any type, and it may be for example, a picture of a car or a tower. The number of types of features may be any number and it may be ten types or fifteen types. The number of reels may be any number, and it may be three, four or six. The number of features displayed on each reel may be any number, and it may be four or five. The number of line numbers may be any number, and it may be twenty one or more. The number of lines may be any number. Also, it is not limited for a player to obtain a prize amount only when the features are aligned, it may be in any form. For example, it may be when the normal features are aligned.

Figure 7:
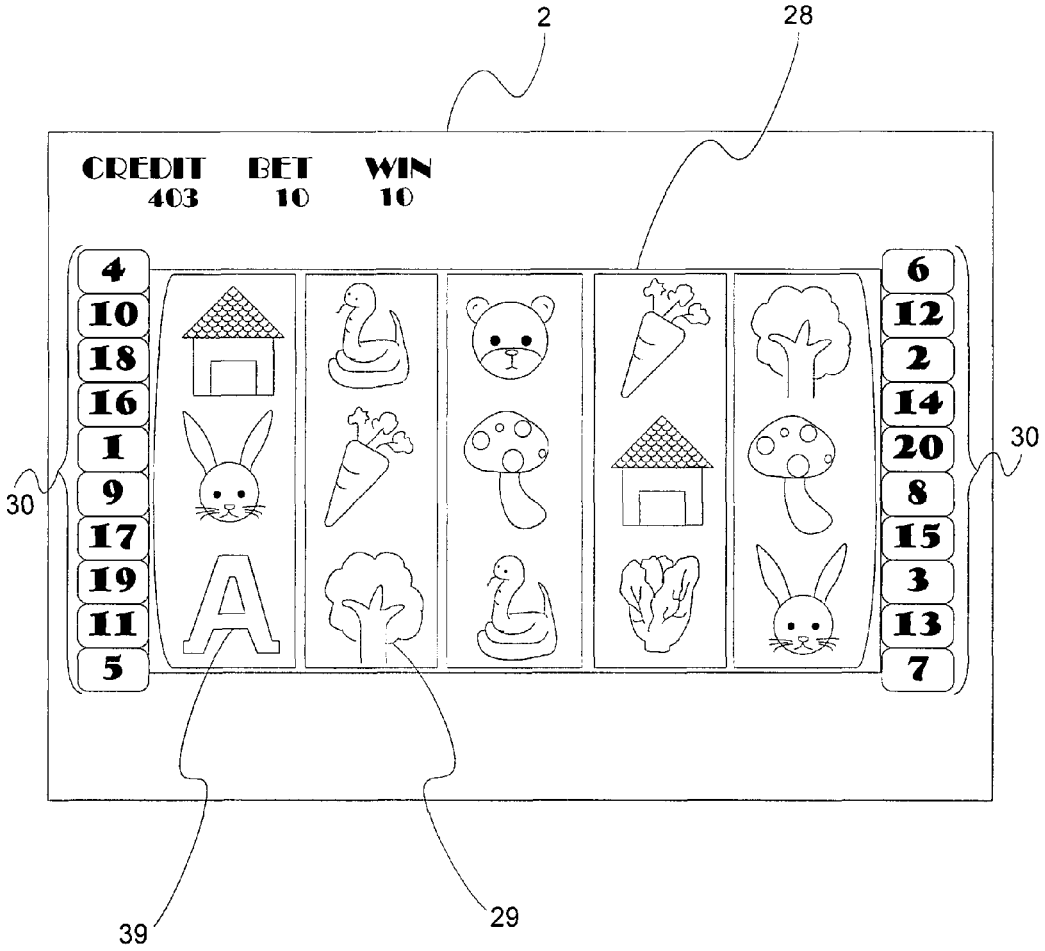
FIG. 7 shows an example of a display screen during a primary game.

FIG. 7 shows an example of a display screen during a primary game. A plurality of reels 28, normal features 29, features 39, and line numbers 30 are displayed on the display screen 2. First, a player selects a bet amount and lines. The reels spin when the player instructs them to spin, and features stop at the predetermined positions. When the features align on the selected line, the player can move on to a bonus game, a free game, or a progressive game. It is not limited for a player to move on to the bonus game, the free game, or the progressive game only when the features align, it may in any form. For example it may be when a combination of the feature and the normal features are aligned. Also, the time the player can move on may be decided regardless of features. For example, it may be decided based on, for example, the number of spins of the reels, or time of play.

Figure 8:
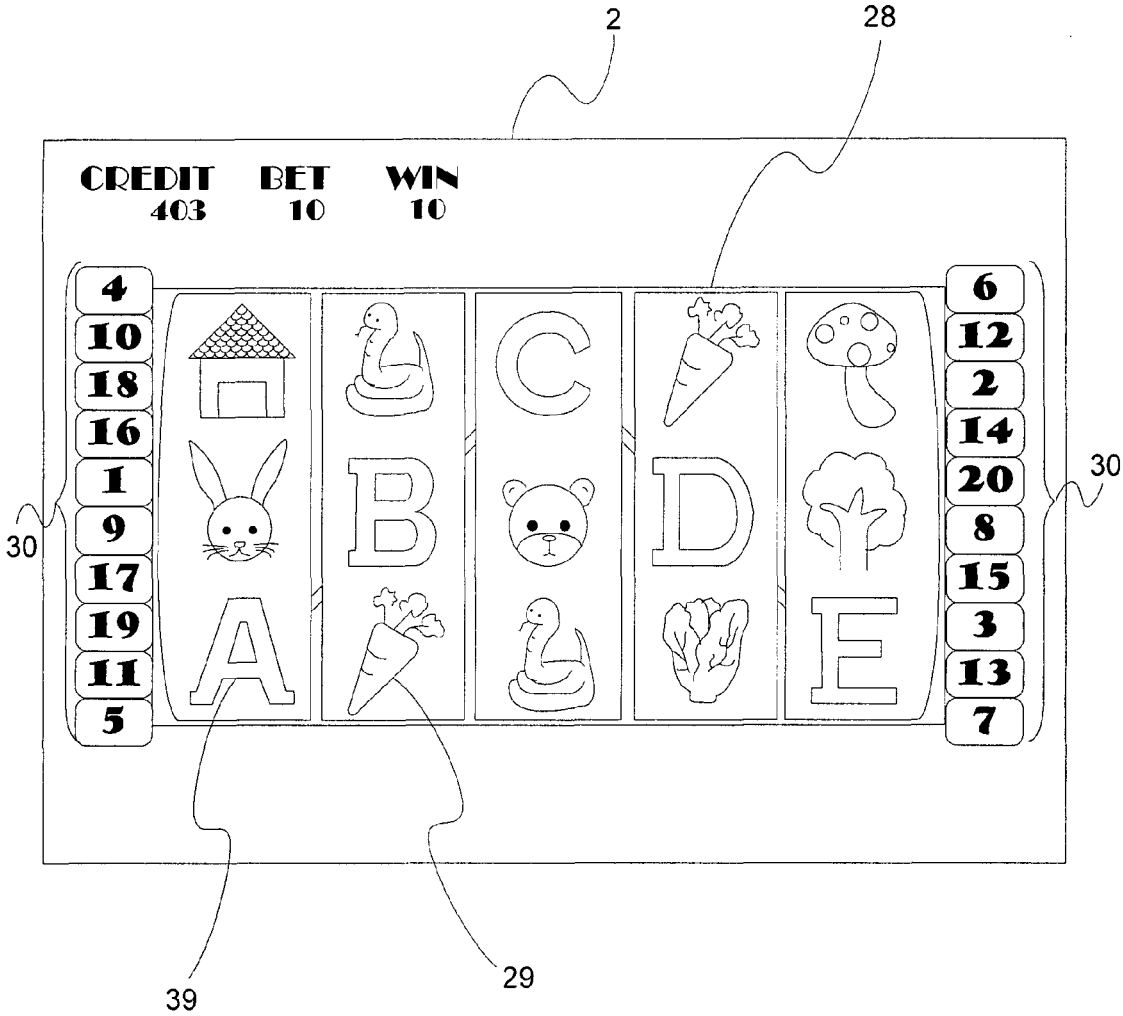
FIG. 8 shows a display screen in which specific features corresponding to a bonus game are lined on reels.

FIG. 8 shows a display screen in which specific features correspond to a bonus game, a free game, or a progressive game aligned on the reels. A plurality of reels 28, a normal feature 29, a feature 39, and line numbers 30 are displayed on the display screen 2. In this figure, the specific features are A, B, C, D, and E. The specific features appear during a primary game, a bonus game, a free game, or a progressive game. A player may select one or more specific features. When one or more features are selected, the player is offered a bonus game, a free game, or a progressive game corresponding to that feature. Also, when the player adds an extra bet wager, one or more features are activated. The number of features to be activated may be any number, and it may be three, five or ten. Also, the game rule may change when the player adds the extra bet wager (This includes when player changes a bet amount). As described below, the change of game rules is to increase the number of active features, or to give advantageous conditions to a player. However, the game rule is not limited to this. Also, the change of game rule may be made not only in a bonus game, but also in other games, such as a primary game.

Figure 9:
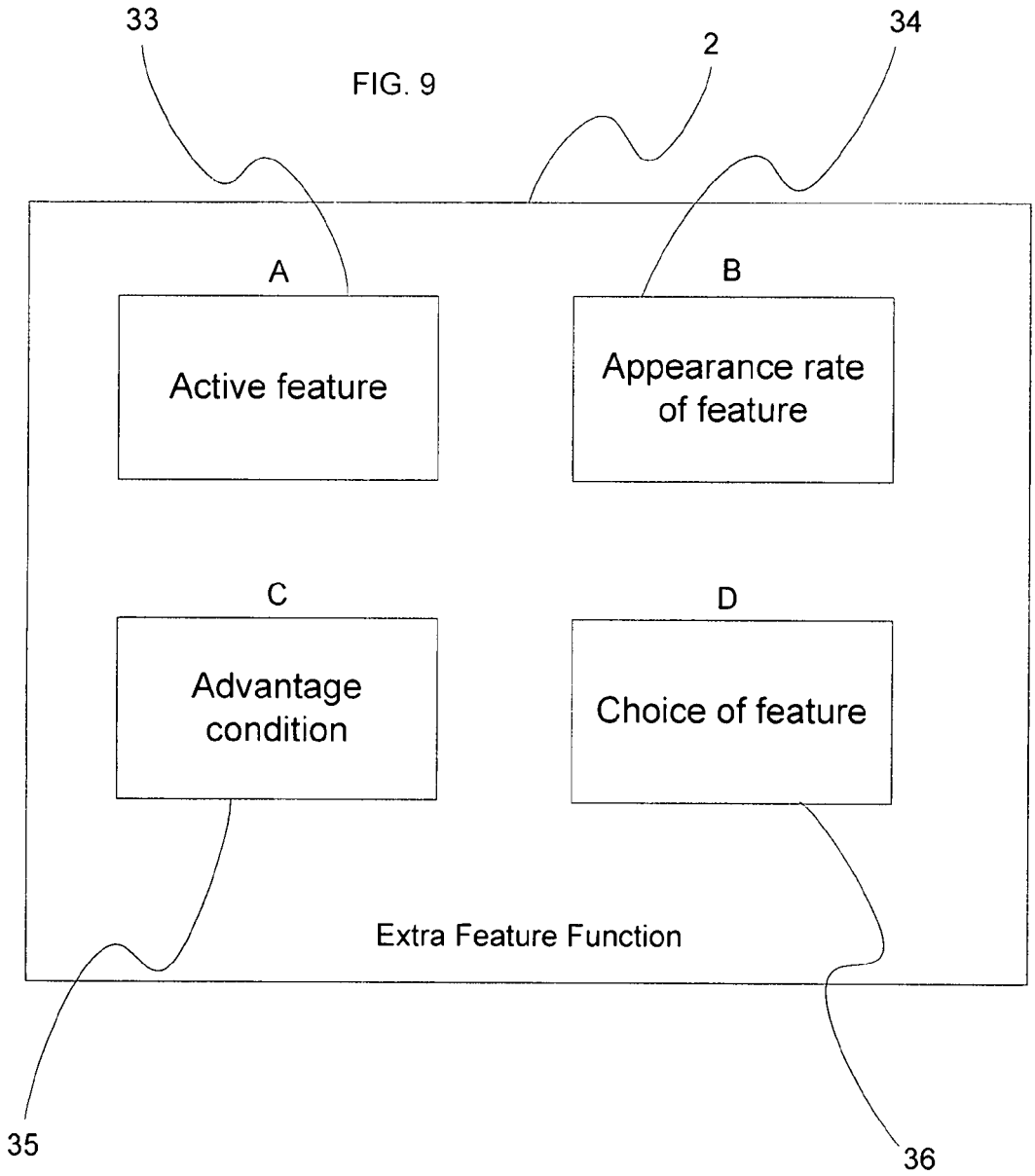
FIG. 9 shows a display screen to select the type of bonus game by a player.

FIG. 9 shows a display screen that allows a player to select a type of bonus game. As explained in FIG. 7, when specific features align on the plurality of reels 28, the display screen 2 shows a display indicated in FIG. 8 for a player to play a bonus game. The display screen 2 shows an active feature 33, a feature appearance ratio 34, advantageous condition 35 and feature selection 36. The display on the display screen is not limited to this and it may display other things. For example, a display to continuously provide motion pictures while a player selects a bonus game may be provided.

Figure 10:
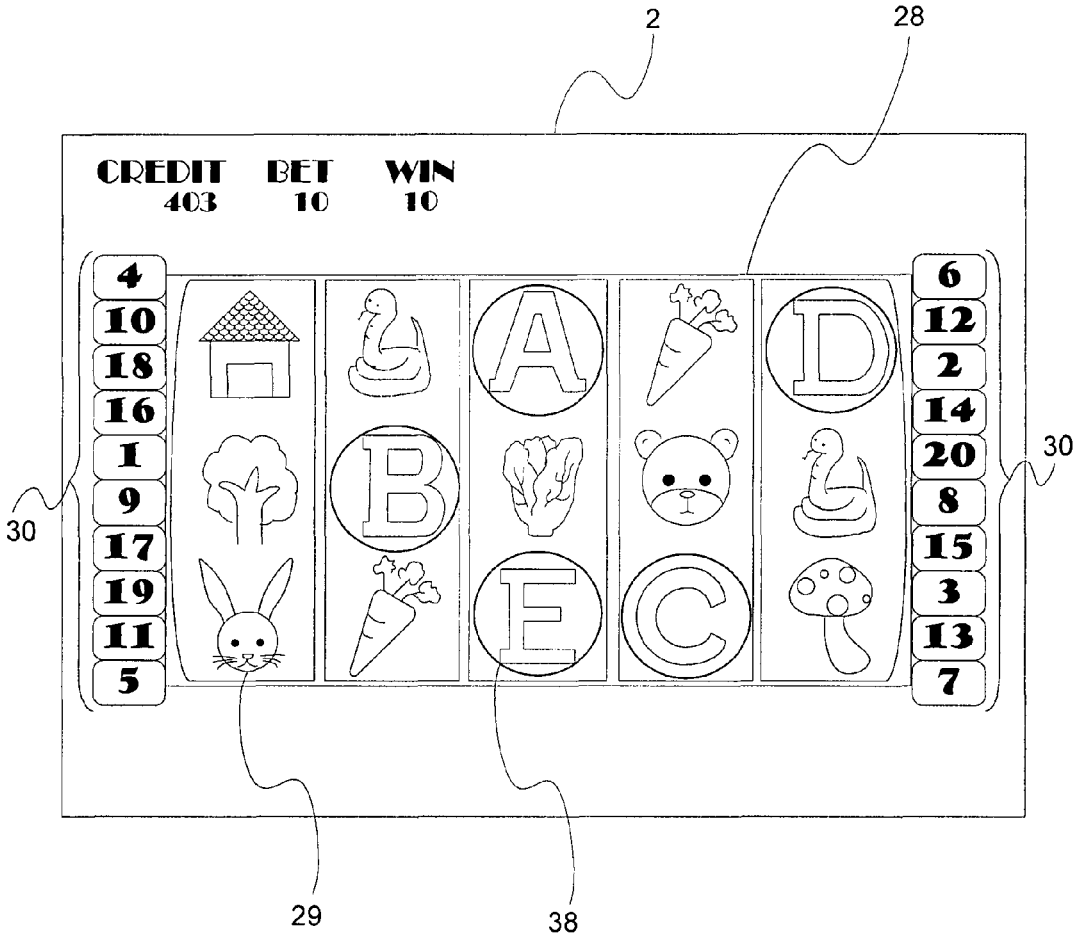
FIG. 10 shows a display screen after offering an active feature function to a player.

FIG. 10 shows a display screen after offering a player one or more active features. A plurality of reels 28, a normal feature 29, line numbers 30, and an active feature 38 are shown on the display screen 2. When a player changes a bet amount, the number of active features among the plurality of features increases in a primary game, bonus game, a free game or a progressive. By comparing the FIG. 10 with the FIG. 7 which shows a display screen during the primary game, it can be appreciated that a number of active features exists on the reels 28 in FIG. 10. When the number of active features on the reels increases, it is easier to start a bonus game, and the amount of payout to a player or the possibility for a player to win increases.

Figure 11:
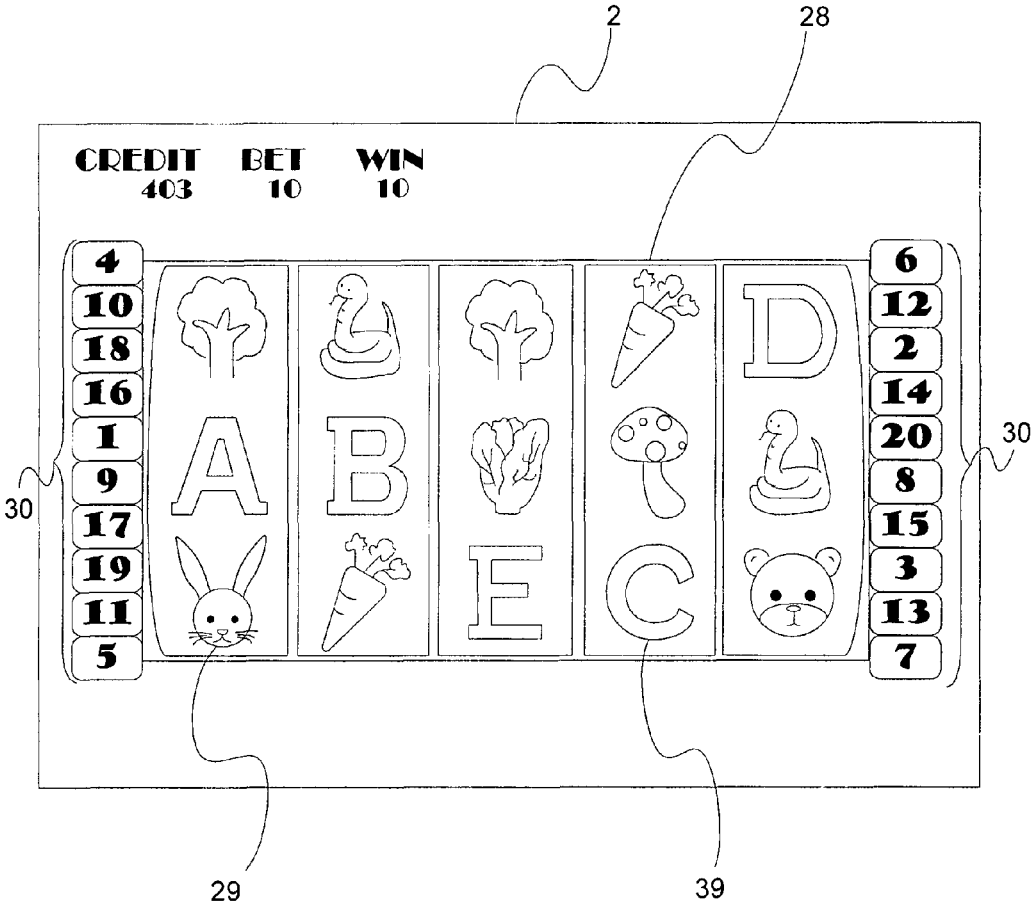
FIG. 11 shows a display screen after offering a feature appearance ratio function.

FIG. 11 shows a display screen after offering a player with a feature appearance ratio function. A plurality of reels 28, a normal feature 29, a feature 39, and line numbers 30 are shown on the display screen 2. The feature appearance ratio is the function that increases the appearance ratio of specific function 39 in a primary game, a bonus game, a free game or a progressive game when a player changes a bet amount. In this figure, the specific features 39 refer to A, B, C, D, and E. By comparing the FIG. 11 with the FIG. 7 which shows a display screen during the primary game, it can be appreciated that a number of specific features 39 exists on the reels 28 in FIG. 11. When the number of specific features 39 on the reels increases, it made easier to start a bonus game, and the amount of payout to a player or the possibility for a player to win increases.

Figure 12:
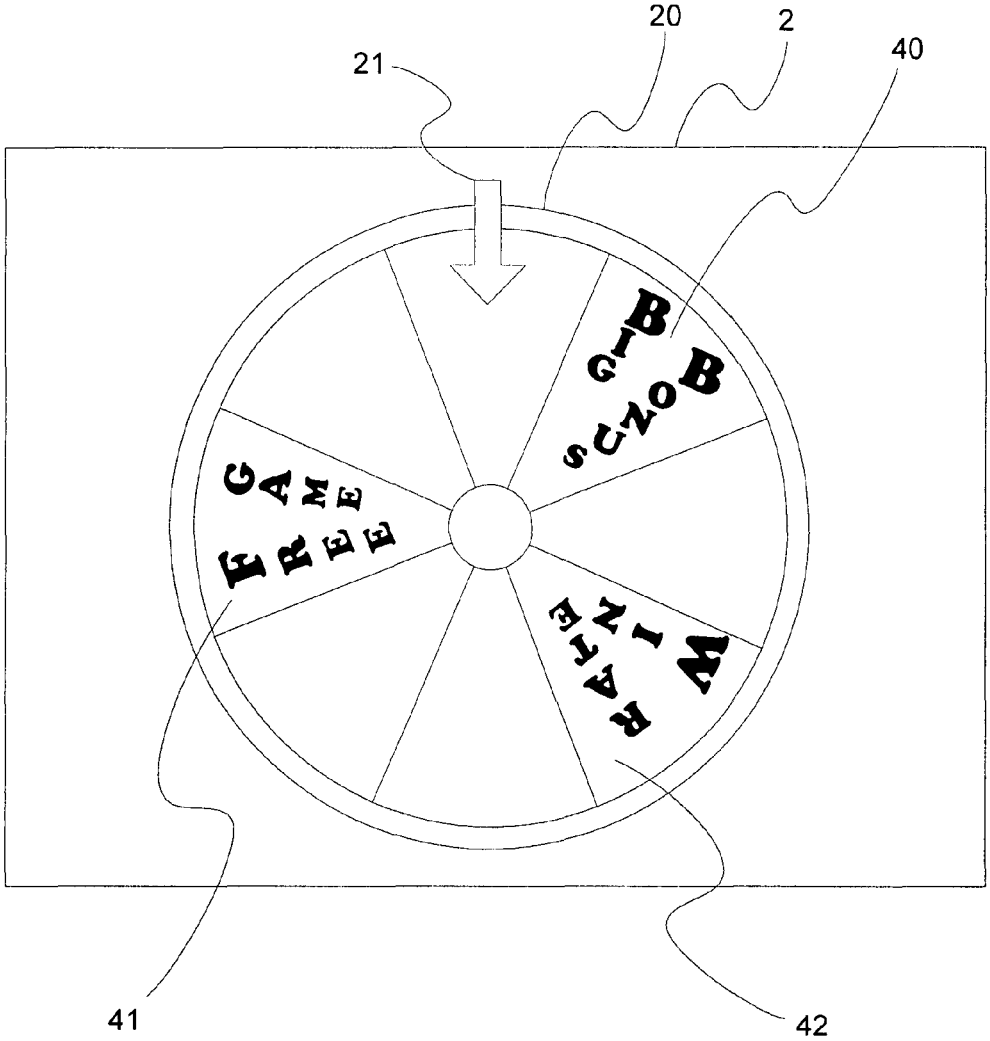
FIG. 12 shows a display screen when offering a favorable condition to a player.

FIG. 12 shows a display screen when offering a player with advantageous conditions. A spin wheel 20 and a fixed arrow 21 are shown on the display screen 2. The wheel 20 has a plurality of columns, and each column shows a big bonus 40, a game free 41, and a win rate 42. The arrow 21 is attached so that it can point at each column of the spinning wheel 20. The advantageous conditions 35 are the functions to play a primary game, a bonus game, a free game or a progressive game with an advantageous condition when a player changes a bet amount. In this figure, the advantageous conditions are the big bonus 40, game free 41 and win rate 42.

The big bonus 40 increases the amount of payout to a player in a bonus game. Increasing the amount is not limited only to a payout amount of an overall bonus game, it may be in any case. For example, in a case where the bonus game consists of a plurality of stages, the amount to be paid out may be increased by each stage. The game free 41 increases the number of free games than can be played by a player. Also, not only increasing the number of free games, but also, the number of stages may also increase in a bonus game. The win rate 42 increases the possibility for a player to win the bonus game or the primary game. Also, the possibility of winning the big bonus may also increase. The types of advantageous conditions are not limited to this, and it may be any number of types. For example, it may be a combination of the types of advantageous conditions explained above.

Figure 13:
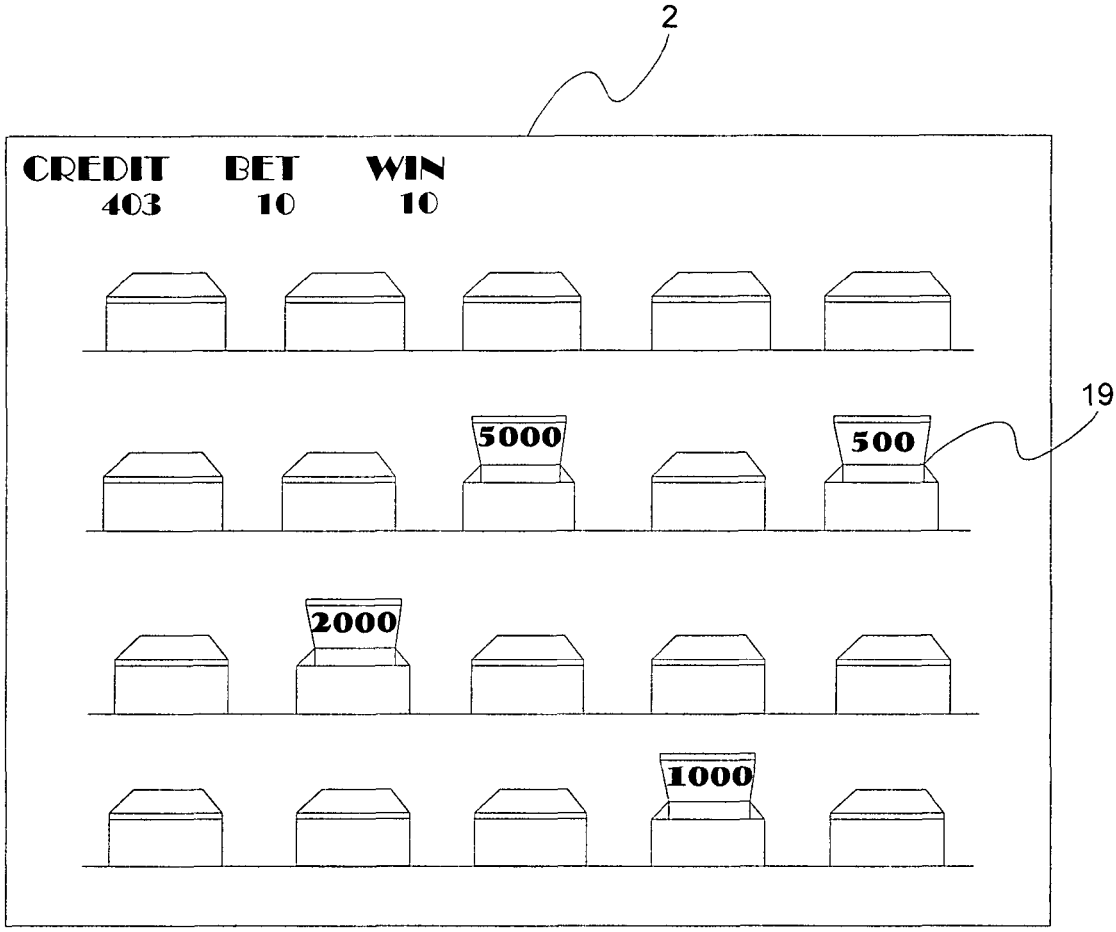
FIG. 13 shows a display screen after offering a feature alternative function to a player.

FIG. 13 shows a display screen after offering a player with a feature selection function. The display screen 2 displays a plurality of boxes. A display 19 of the amount paid out to a player is in the box. The feature selection 36 (shown in FIG. 9) is a function to increase the selection of features in a primary game, a bonus game, a free game, or a progressive game when a player changes a bet amount. By comparing the FIG. 13 and the FIG. 3 of a box game not offering the feature selection function, it can be appreciated that the number of boxes that can be selected by a player increases and further the amount to be paid out to the player also increases.

In a case where the player is offered the feature selection function, the type of features to be selected may be changed, or two or more features may be selected when selecting a bonus game, a free game, or a progressive game as described in FIG. 8. For example, when the player selects two features, the bonus game, the free game, or the progressive game that has above two functions may be played.

The bonus game that can be selected by the player is not limited as described above, and it may be any time. For example, one feature is the function to increase the level, and the big bonus may be given to a player when at least one feature with increased level appears on the reels even without a feature aligning on the reels. Also, a function combining two or more functions may be provided. For example, it is a function that increases active features and further increases an appearance ratio of a feature.

Also, the pay table in the bonus game may change when the player changes a bet amount. Also, the function of a special symbol in the bonus game may be changed or the possibility for the special symbol to appear may be changed when the player changes a bet amount. The special symbol is the symbol that appears during the primary game or the bonus game. When the special symbol appears, the bonus game is started, the player is paid out with a prize, or the player is offered with an advantageous condition. Also, when the player changes a bet amount, the appearance ratio of a trigger which is a sign of the start of a bonus game may be changed.

Figure 14:
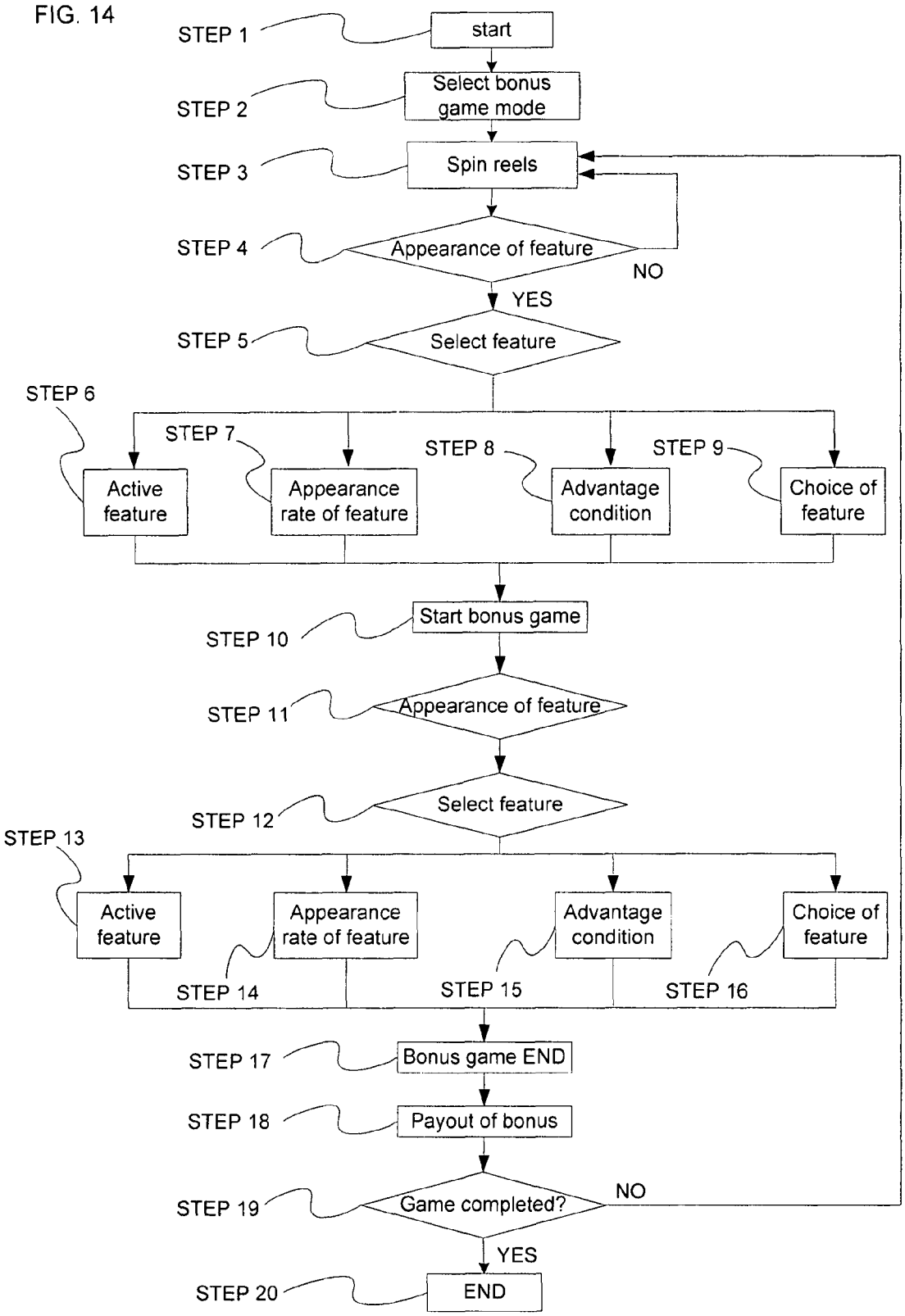
FIG. 14 shows a flow chart of a game which allows a player to select game rules.

FIG. 14 shows a flow chart of a game that allows a player to select a bonus game and the like. First, when a primary game is started (step 1), a screen to select the type of bonus game to be performed in the game is displayed (step 2). The type of bonus game to be selected may be one or a plurality of types. When the type of bonus game is selected, the display screen shows a plurality of reels. Also, when the player instructs them to spin, the reel begins to spin (step 3). The spin stops automatically after a certain time. The stop may be made by the player.

When a specific feature is displayed on the stop screen (step 4), the feature selection screen is displayed (step 5). At this time, the player is given an opportunity to change a bet amount. When the player increases the bet amount, one or more feature may be activated, and the features that can be selected by the player may change. And, for example, the player may select one function out of an active feature (step 6), a feature appearance ratio (step 7), an advantageous condition (step 8), and a feature selection (step 9). The details of these functions are as described in FIGS. 10 to 13. The types of the function are not limited to these, and they may be any type. Alternatively, one or more functions may be selected at the same time.

When the function is selected, the bonus game which offers the function, starts (step 10). When the specific feature is displayed in the game and the bet amount is increased (step 11), the player is given an opportunity to select one function out of an active feature (step 13), a feature appearance ratio (step 14), an advantageous condition (step 15), and a feature selection (step 16) again (step 12). In this way, when the player is offered the features two or more times, the bonus game resumes while the player is offered two or more selected functions.

When the bonus game is completed (step 17), the amount obtained by the player in the bonus game will be paid out (step 18). And, a determination is made as to whether the player resumes the primary game or not (step 19). When the game is resumed, the reels are spun again (step 3). In a case where the primary game is resumed, the function offered to the player in the above process may continue to be function in the primary game. When the game is not resumed, the game is over (step 20).

Figure 15:
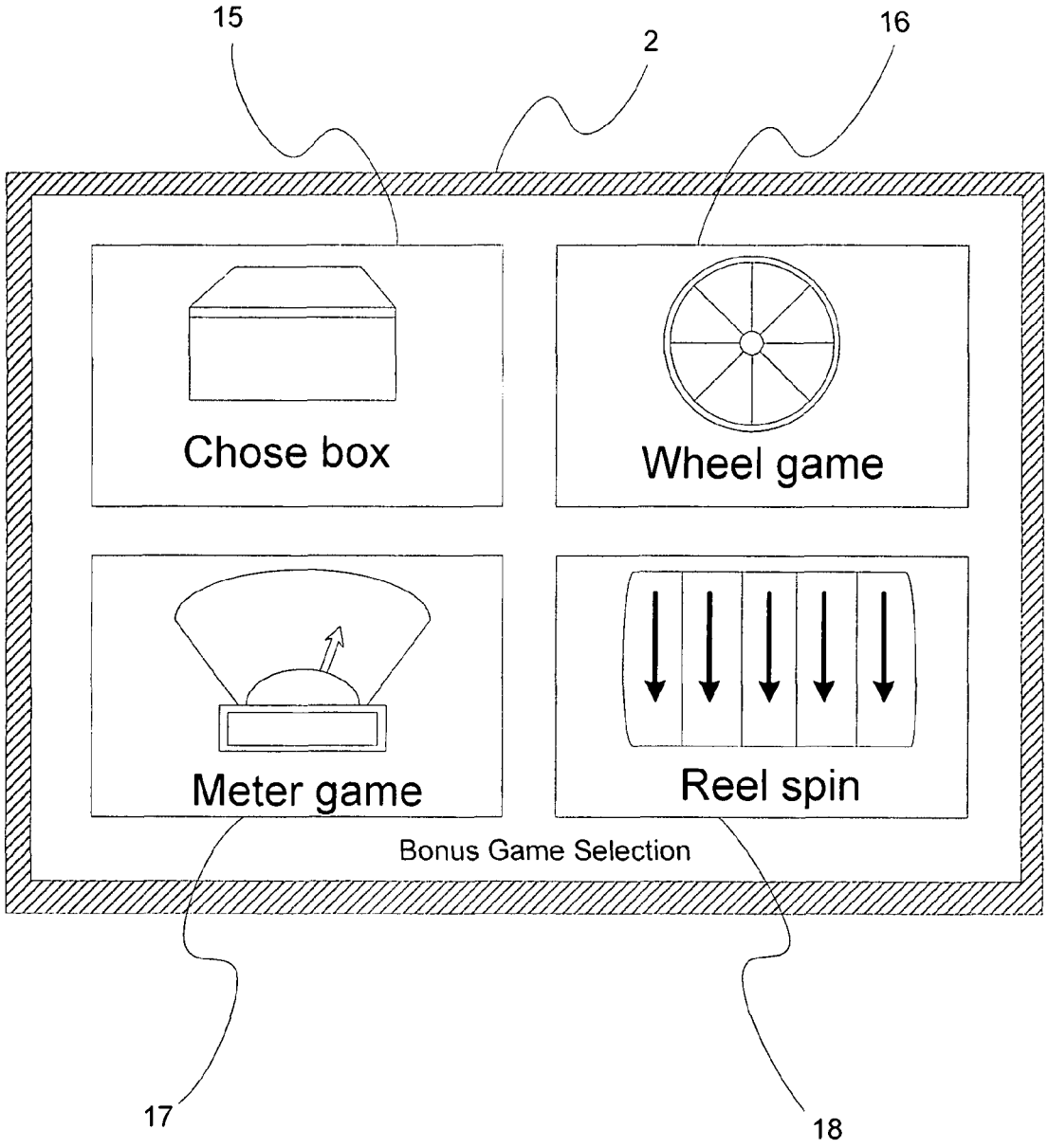
FIG. 15 shows an example of a display on the display screen according to the present invention when selecting a bonus game.

The amount to be paid out to a player in a bonus game according to the player's bet, or a gaming machine that can change a player's winning probability is hereinafter explained in detail. FIG. 15 shows an example of a display on the display screen according to the present invention at the selection of a bonus game. The player selects the bonus game type to be started in a primary game before starting the game. Bonus games comprising a choose box 15, a wheel game 16, a meter game 17, and reel spin 18 are displayed on the display screen 2. The contents of these bonus games are the same as those explained in FIGS. 2 to 6 above. As explained in FIG. 2 to 6, these bonus games are not limited specifically and they may be in various forms.

Figure 16:
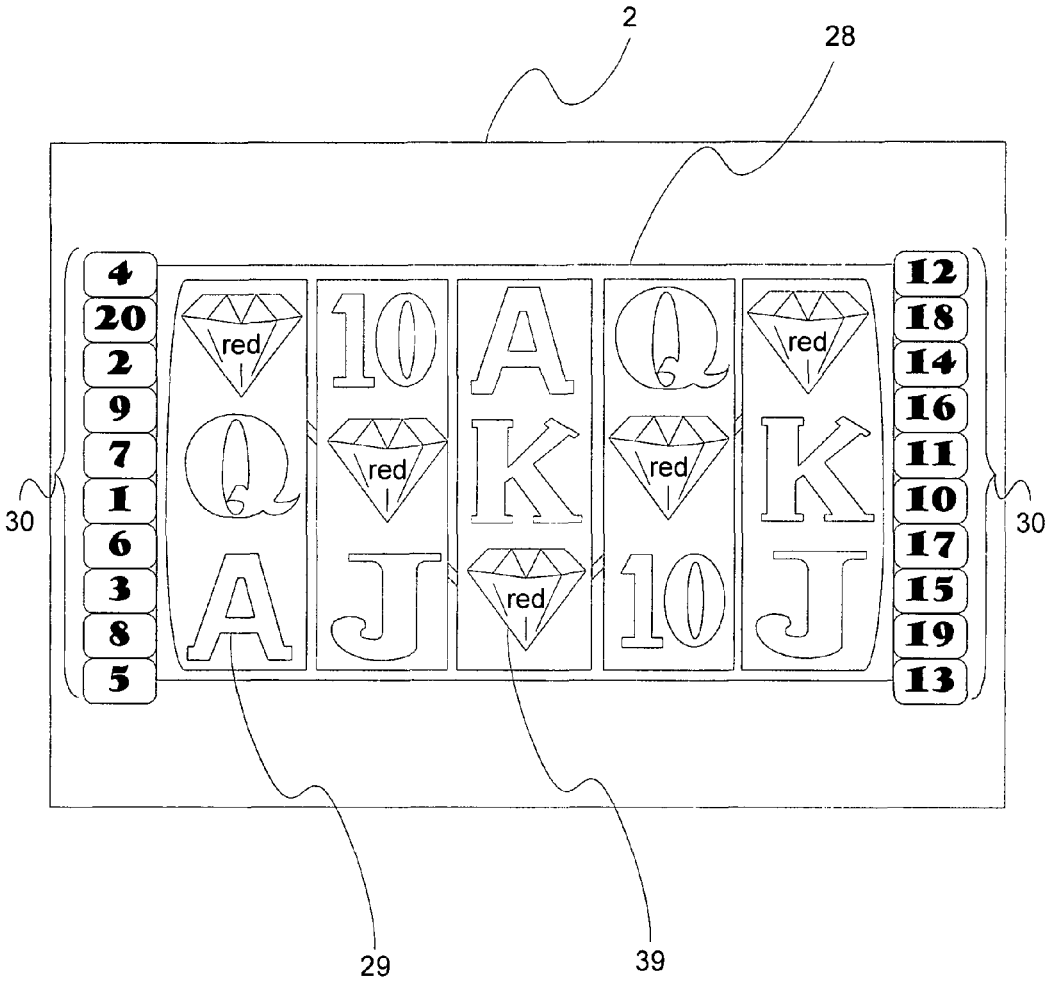
FIG. 16 shows an example of a transition screen from a primary game to a bonus game or a progressive game.

FIG. 16 shows an example of a transition display from a primary game to a bonus game or a progressive game. A plurality of reels 28, normal feature 29, feature 39, and line number 30 are displayed on the display screen 2. First, a player selects a bet amount and line. Then, the reels start to spin when the player instructs the reel to spin, and the feature stops at a predetermined position. At this time, if the features line up on the selected line as shown in the figure, the player can proceed to the bonus game or the progressive game. Proceeding to these games is not limited to when the features are lined up, and it may be any form, such as when the normal features align. The types and the number of features, the number of reels, the number of features shown on each reel, the number of line numbers, and types of lines are not limited as explained FIG. 6 above and they may in any form.

Figure 17:
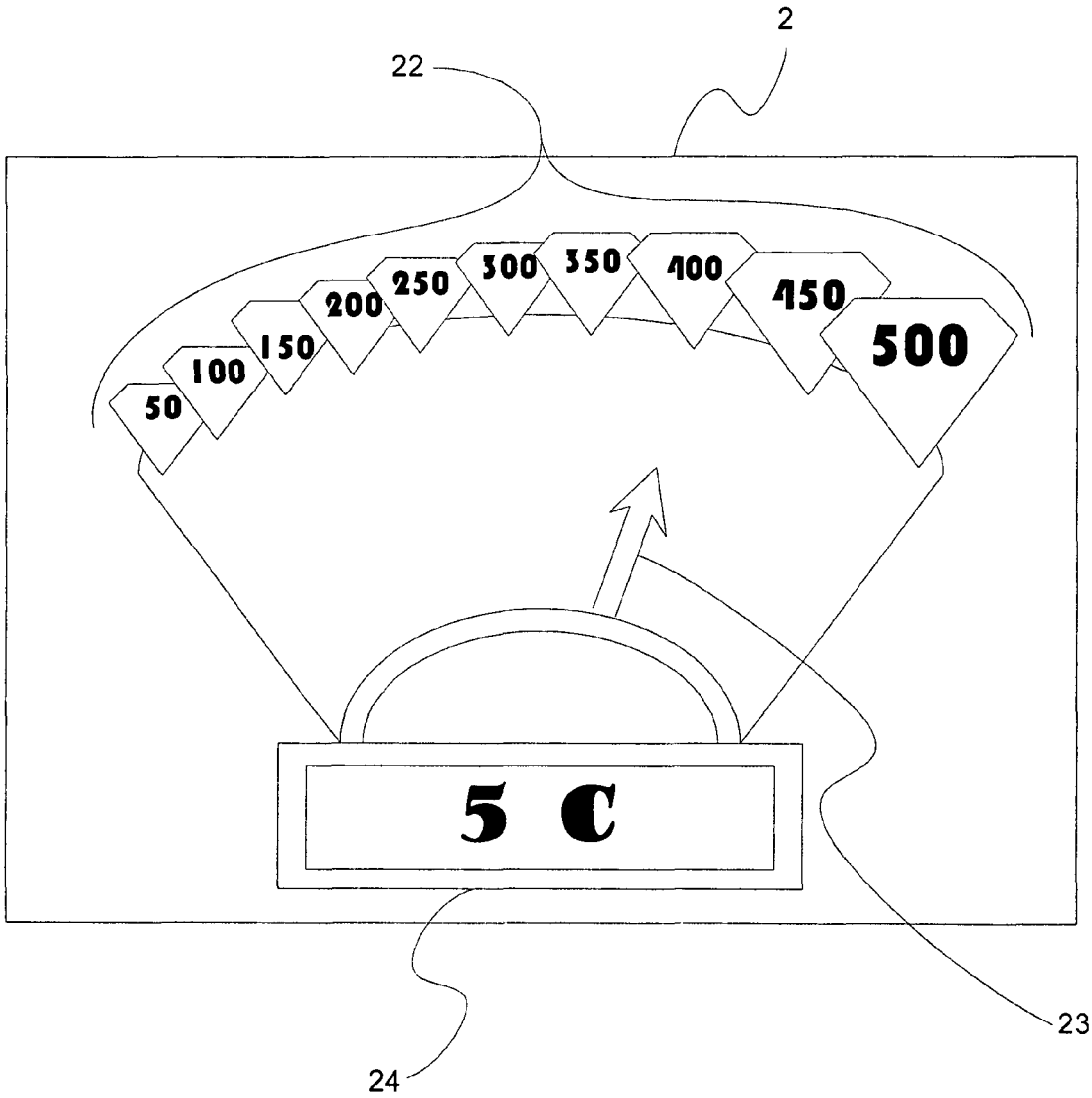
FIG. 17 shows an example of a bonus game which allows a player to change a bet amount.

FIG. 17 shows an example of a bonus game that allows a change of a bet amount. FIG. 17 shows the condition before a player changes the bet amount. The display screen 2 shows a meter game 17, that is a bonus game. In the meter game 17, first a prize amount display 22, an arrow 23, and a players bet amount display 24 are shown on the display screen 2. The arrow 23 can move so as to point to each of the prize amount display 22. The arrow 23 starts to move when the player instructs it to start, and the arrow 23 points to any one of the prize amount display 22 and stops when the player instructs it to stop. The player can obtain the amount pointed by the stopped arrow.

Figure 18:
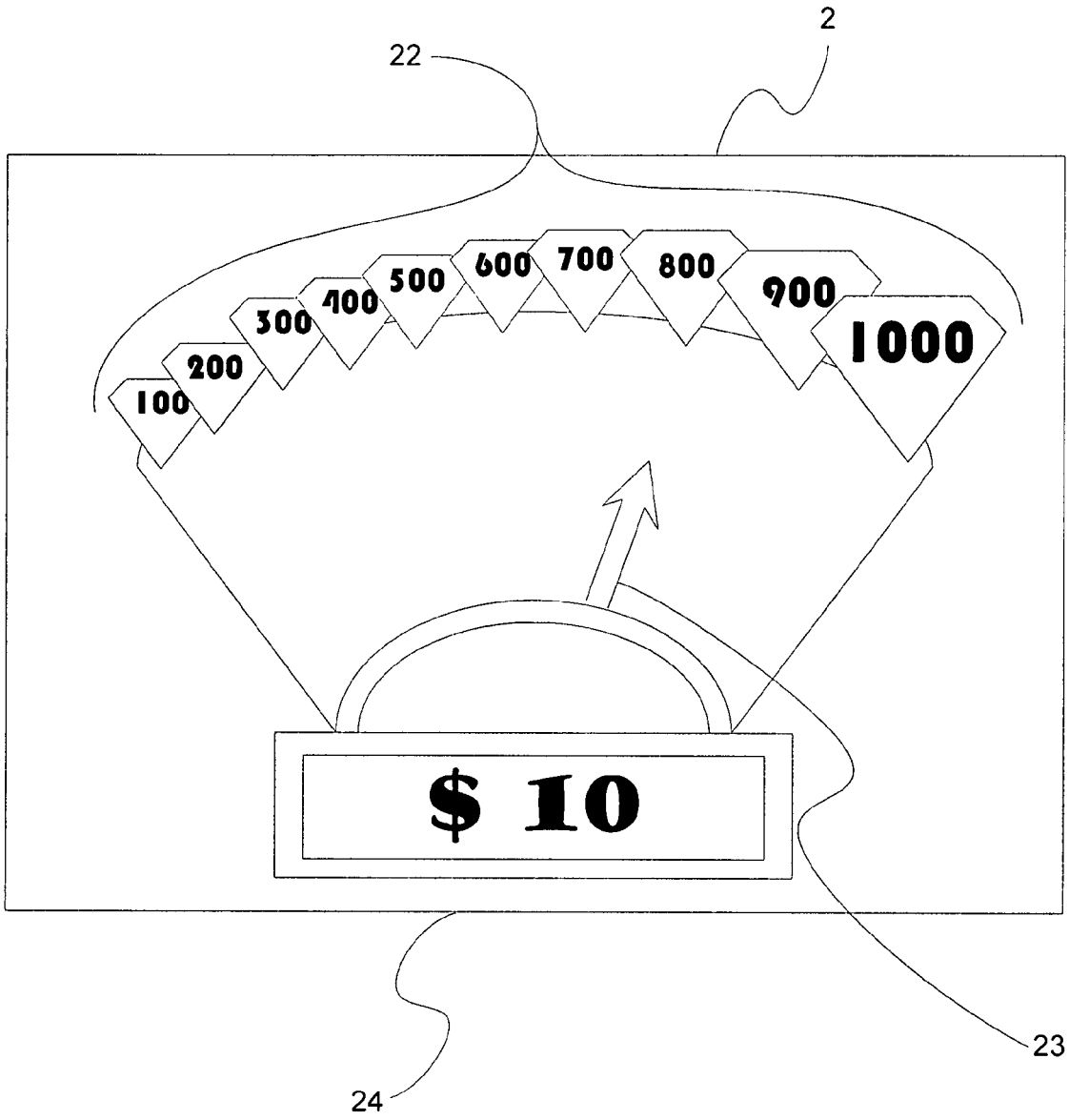
FIG. 18 shows an example of a bonus game which allows a player to change a bet amount.

FIG. 18 shows an example of a bonus game that allows a player to change a bet amount. FIG. 18 shows a condition after a player changes the bet amount. The display screen 2 shows a meter game 17 (as discussed in connection with FIG. 2), that is, a bonus game. The display screen 2 displays a prize amount display 22, an arrow 23, and a player's bet amount display 24. Comparing FIGS. 17 and 18, the prize amount display 22 increases as a player increases the bet amount and the amount of the bet amount display 24 increases. In this way, the player may increase the amount to be paid out at a bonus game by increasing the bet amount at the beginning of the bonus game.

Also, it is not limited to the prize amount that can be increased when the player increases the bet amount, and it may be anything. For example, the winning possibility of the bonus game may be increased. Also, only the prize amount desired to change out all the prize amount display may be increased. Also, it may be configured as to win only a high prize amount by deleting a low prize amount from the prize amount display. Also, the player may decrease the bet amount. In addition, the time when the player can increase the bet amount is not limited to the beginning of a bonus game, and it may be any time. For example, it may be during a primary game or a bonus game.

The meter game is not limited specifically and it may be in different forms. For example, the number of meter games or arrows may be any number, and it may be two or three. The number of prize amount display on the meter may be any number, and it may be eight or twelve. The shape of the arrow may be a pointing finger. Also, a display that boosts game presentation, such as blooming of colorful flowers, may be displayed.

Figure 19:
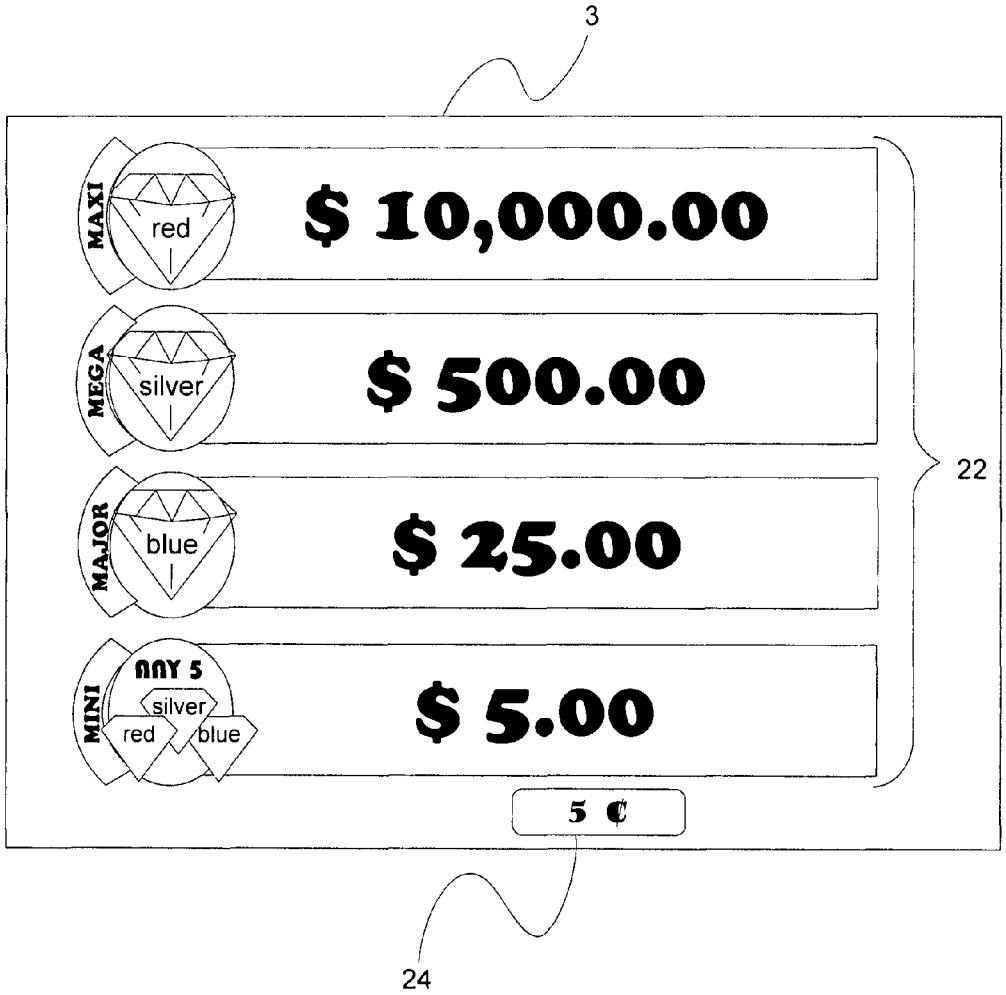
FIG. 19 shows an example of a progressive game which allows a player to change a bet amount.

FIG. 19 shows an example of a progressive game that allows a player to change a bet amount. FIG. 19 shows a condition before a player changes the bet amount. The display screen 3 shows a prize amount display 22 to be paid out in a bonus game and a bet amount display 24 of a player. The player can increase the prize amount 22 to be paid out by adding to the bet amount.

Figure 20:
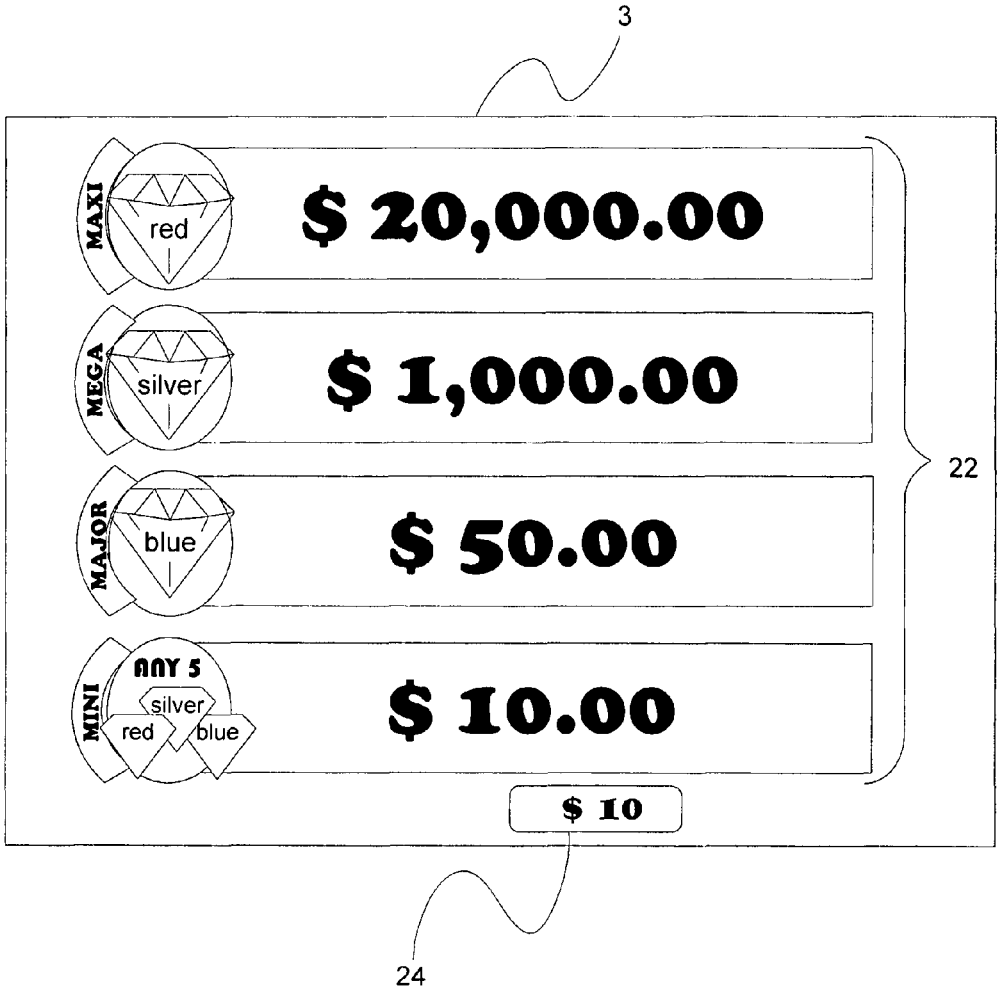
FIG. 20 shows an example of a progressive game which allows a player to change a bet amount.

FIG. 20 shows an example of a progressive game that allows a player to change a bet amount. FIG. 20 shows a condition after a player changed a bet amount. The display screen 3 shows a prize amount display 22 to be paid out at a bonus game and a bet amount display 24 of the player. Comparing the FIGS. 19 and 20, the prize amount display 22 increases as a player increases a bet amount and the amount of the bet amount display 24 increases. In this way, the player may increase the mount to be paid out at a bonus game by increasing the bet amount at the beginning of the bonus game.

Also, it is not limited to the prize amount that can be increased when the player increases the bet amount, and it may be anything. For example, the winning possibility of the bonus game may be increased. Also, only the prize amount desired to change out all the prize amount display may be increased. Also, it may be configured as to win only a high prize amount by deleting a low prize amount from the prize amount display. Also, the player may decrease the bet amount. In addition, the time when the player can increase the bet amount is not limited to the beginning of a bonus game, and it may be any time. For example, it may be during a primary game or a bonus game.

Figure 21:
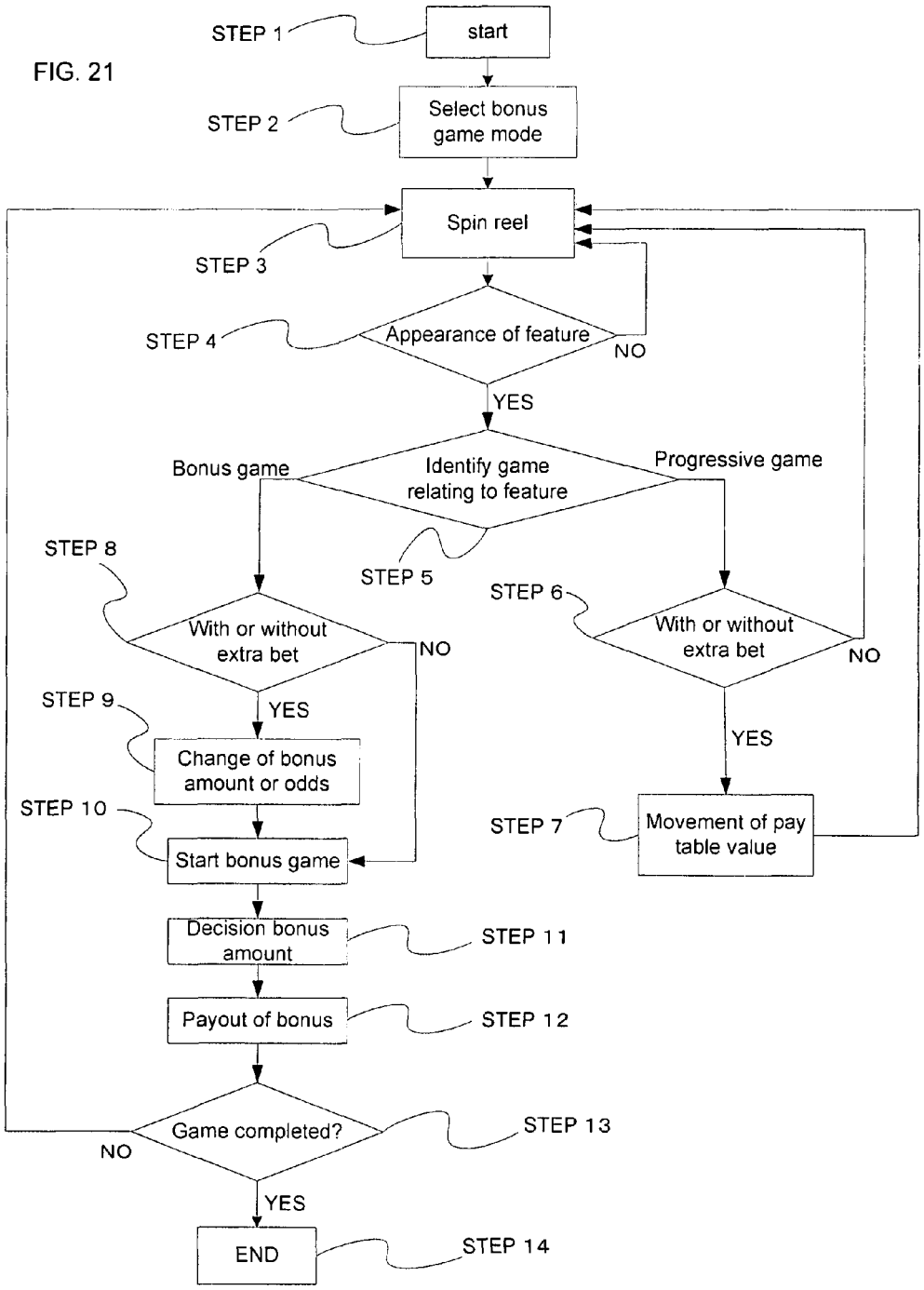
FIG. 21 shows a flow chart of a game which allows a player to change a bet amount.

FIG. 21 shows a flow chart of a changeable bet amount game. First, a primary game starts (step 1), and a display for selecting a type of bonus game to be played in the game (step 2) is presented. The type of bonus game selected may be single or plural. When a type of bonus game is selected, the display screen displays a plurality of reels. And the reels start to spin when the player instruct them to spin. (step 3). The spin automatically stops after a predetermined time. The stop may be made by the player.

When a specific feature is displayed on the stop screen (step 4), a determination is made as to whether the feature corresponds to a bonus game or a progressive game (step 5). When it is determined to be the progressive game, the progressive game is started and a determination is made as to whether there is an addition of a bet amount (step 6). When there is an addition of a bet amount, a prize amount on the pay table increases (step 7) and the primary game resumes (step 3). Where there is no addition of a bet amount, the primary game resumes without increasing the prize amount on the pay table (step 3).

Meanwhile, when the bonus game is determined to correspond with the feature, the bonus game begins and a determination is made as to whether there is an addition of a bet amount or not (step 8). Where there is an addition of a bet amount, the amount to be paid out in a bonus game or a winning possibility increases (step 9), and the bonus game resumes (step 10). When there is no addition of a bet amount, the bonus game resumes without increasing the payout amount or winning possibility (step 10). When the bonus game is completed, the amount to be paid out to the player is determined (step 11), and the payout is made (step 12).

And, a determination is made as to whether the player resumes a primary game or not (step 13). When the game resumes, the reels spin again (step 3). When the game is not resumed, the game is over (step 14).

Figure 22:
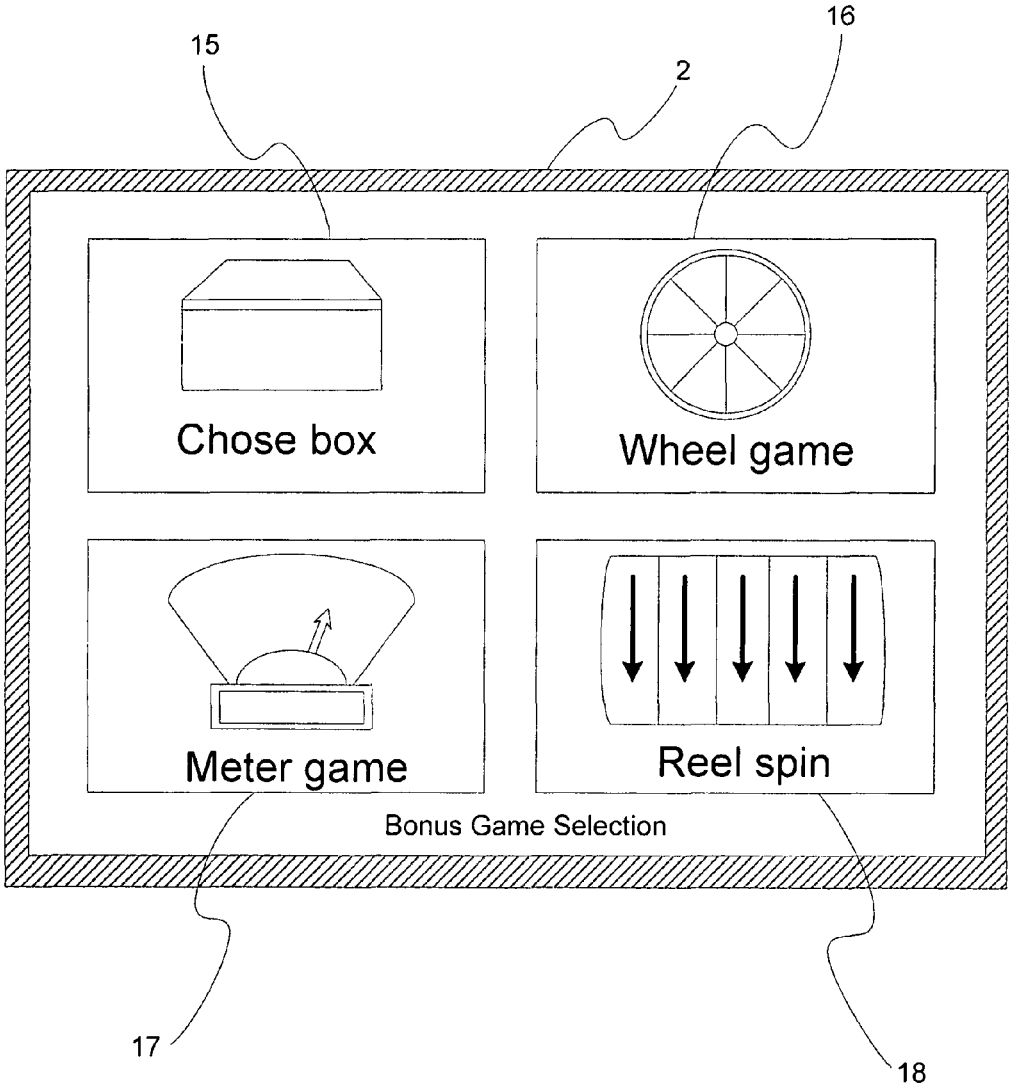
FIG. 22 shows an example of a display on the display screen according to the present invention when selecting a bonus game.

The invention which allows a plurality of players to play a plurality of gaming machines as a team play is hereinafter explained in detail. FIG. 22 shows an example of a display on the display screen according the present invention at the selection of a bonus game. Players select the type of bonus game to be started in a primary game before the game starts. The bonus game of a choose box 15, a wheel game 16, a meter game 17, and reel spin 18 are shown on the display screen 2. The contents of these bonus games are not limited specifically those explained in FIGS. 2 to 6 above, and they may be in various forms.

Figure 23:
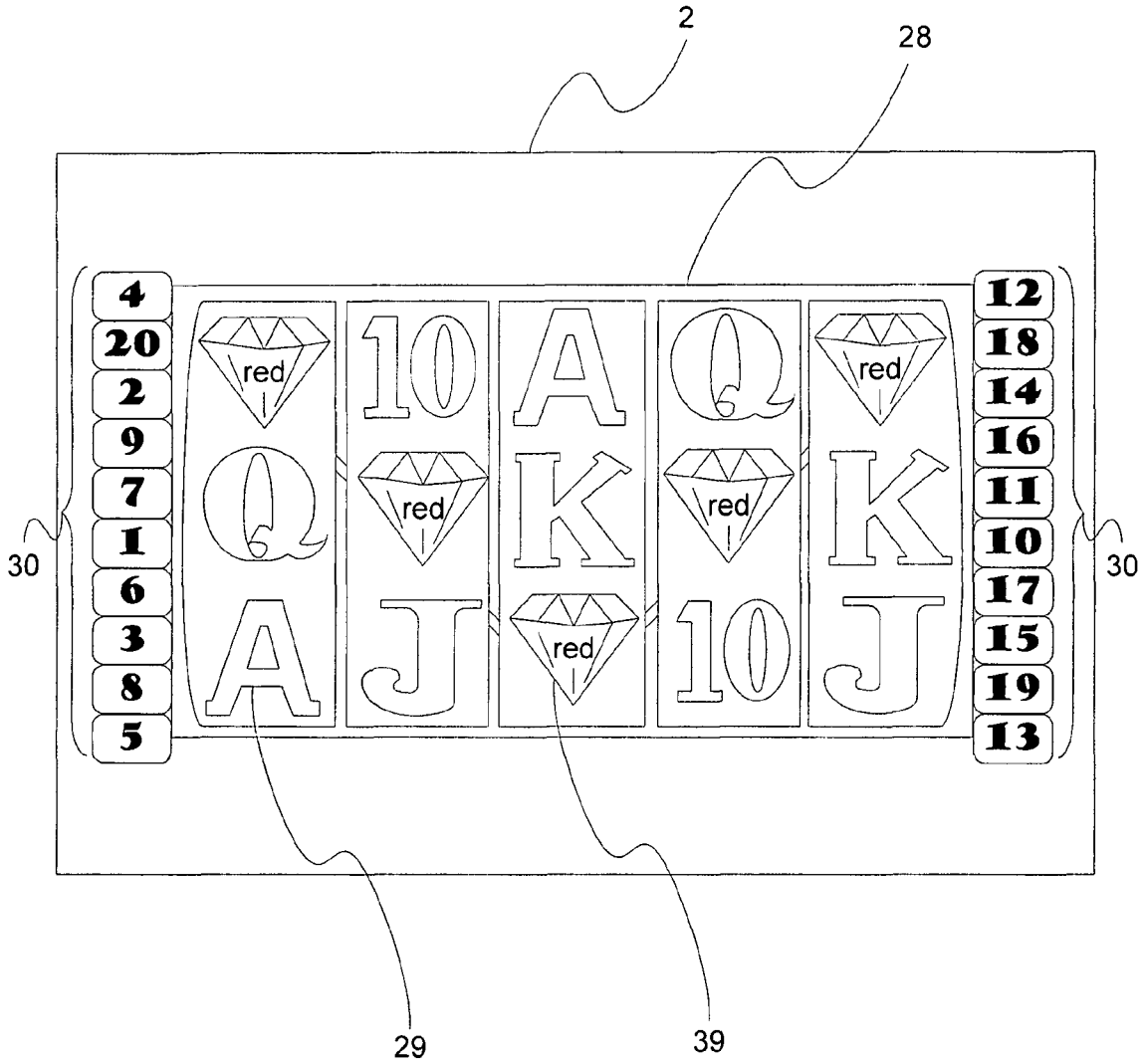
FIG. 23 shows an example of a transition screen from a primary game to a bonus game or a progressive game.

FIG. 23 shows an example of a transition display from a primary game to a bonus game or a progressive game. A plurality of reels 28, normal feature 29, feature 39, and line number 30 are displayed on the display screen 2. First, a player selects a bet amount and line. Then, the reels start to spin when the player instructs the reels to spin, and the feature stops at a predetermined position. At this time, if the features line up on the selected line as shown in the figure, the player can proceed to the bonus game or the progressive game.

The bonus game may be the same as those explained in FIGS. 17 and 18. The progressive game may be the same as those explained in FIGS. 19 and 20. It is not limited for a player to proceed to a bonus game or progressive only when the features line up, as it may be in any form, for example, when normal features line up. Also, the type and the number of feature, the number of reels, the number of features shown on each reel, the number of line numbers, and the type of line are not limited as described in FIG. 6, as it may be various forms.

Figure 24:
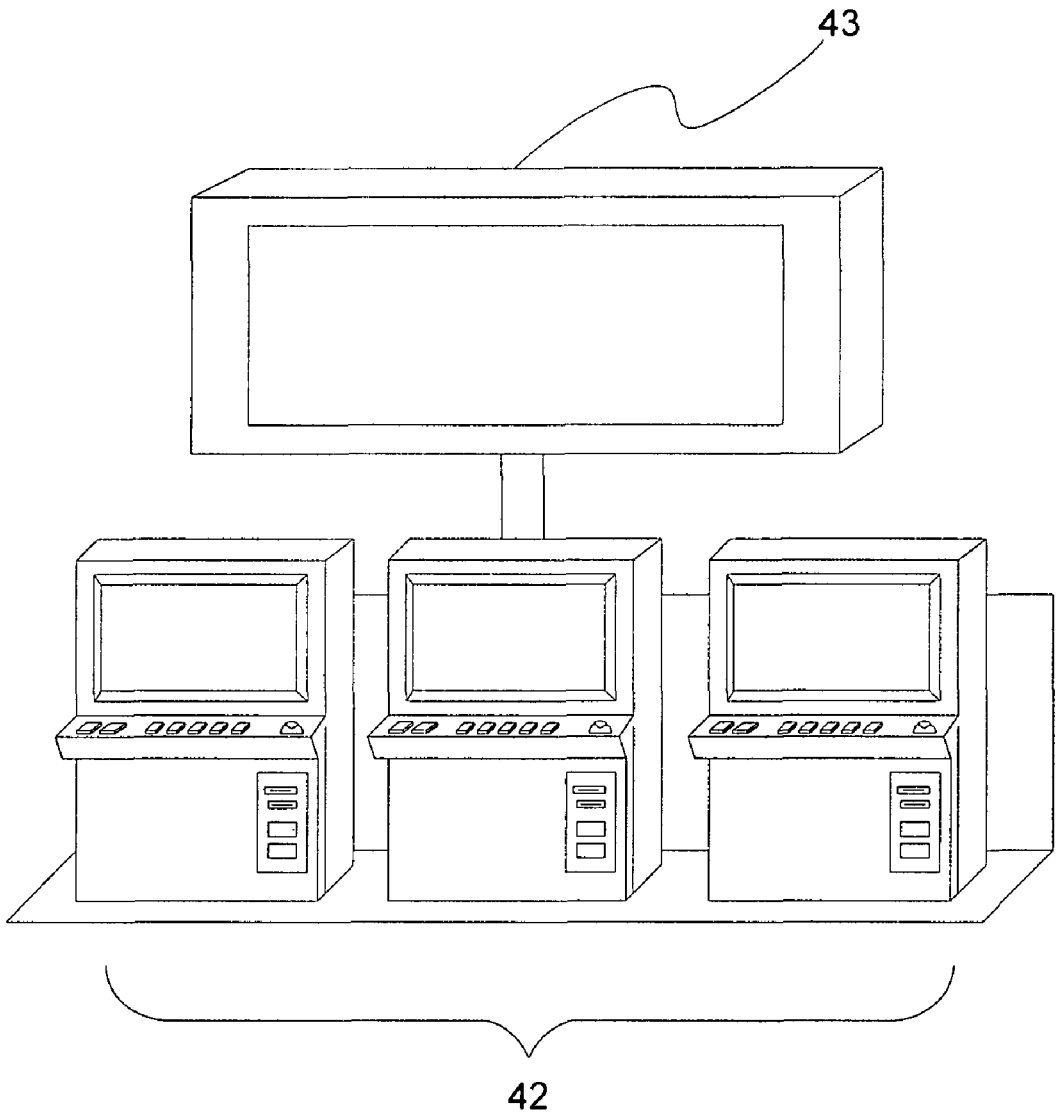
FIG. 24 shows a plurality of gaming machines.

FIG. 24 shows a plurality of gaming machines 42. Each of the plurality of gaming machines 42 is connected to a large display screen 43. The large display screen 43 may display the progressive screen that displays an amount to be paid out to a player as a bonus as shown in FIGS. 19 and 20.

In the plurality of gaming machines according to the present invention, the play result of at least one or more gaming machines out of the plurality of gaming machines may affect the operation of other gaming machines.

Also, in the plurality of gaming machines according to the present invention, when a bonus game or a progressive game is started on at least one gaming machine out of the plurality of gaming machines, the bonus game or the progressive game starts across the plurality of gaming machines. At this time, the gaming machines start the bonus game or the progressive game may be all of the gaming machines or a specific gaming machine.

In the plurality of gaming machines according to the present invention, when the bonus game is played on one or more gaming machine and the amount to be paid out to the player is determined, the amount may be paid out across the plurality of gaming machines.

In the case of a bonus game, the payout amount as a result of play to all the plurality of players may be the same or different. When the payout amount as a result of play is different, the amount is not specifically limited and it may be any amount. For example, a payout amount as a result of play to each player may be decided according to the each player's bet amount, or the amount displayed on each player's progressive screen. When the payout amount is the same, however, the amount is not limited specifically and it may be any amount. Also, there may be a player who has no payout. Meanwhile, in the case of a progressive game, each player may change the same bet amount or they each may change a different bet amount.

In conventional gaming machines, players play a game individually. By configuring as described above, other players can move on to a bonus game when one or more players out of a plurality of players moves on from a primary game to a bonus game. Therefore, it builds a sense of fellowship among players and enables enjoyment of the gaming machine as a team play. Also, a certain player can start a bonus game even when he or she did not draw the bonus game, thereby the player feels very lucky. By configuring as described above, a plurality of players may cooperate with each other. Also, the plurality of players may compete against each other when the amount of payout to each player is different.

Also, the large display screen is not limited to show a progressive screen, and it may show anything. For example, a presentation display, such as fire balls dropping overhead, in order to excite the plurality of players. Also the number of the plurality of gaming machines is not specifically limited and it may be in any number. For example, it may be four, five or six. In addition, the number of large display screens may be any number. It may be two or three as the number of gaming machines increases. The timing for the start of the bonus game or the progressive game may be the same or different for each player.

Further, the bonus game or the progressive game may consist of one or a plurality of stages. It may consist three or five stages. Also, when the bonus game consists of a plurality of stages, a plurality of styles of play may exist, the number of the styles may be any number. A specific example of the style of play is hereinafter explained.

Figure 25:
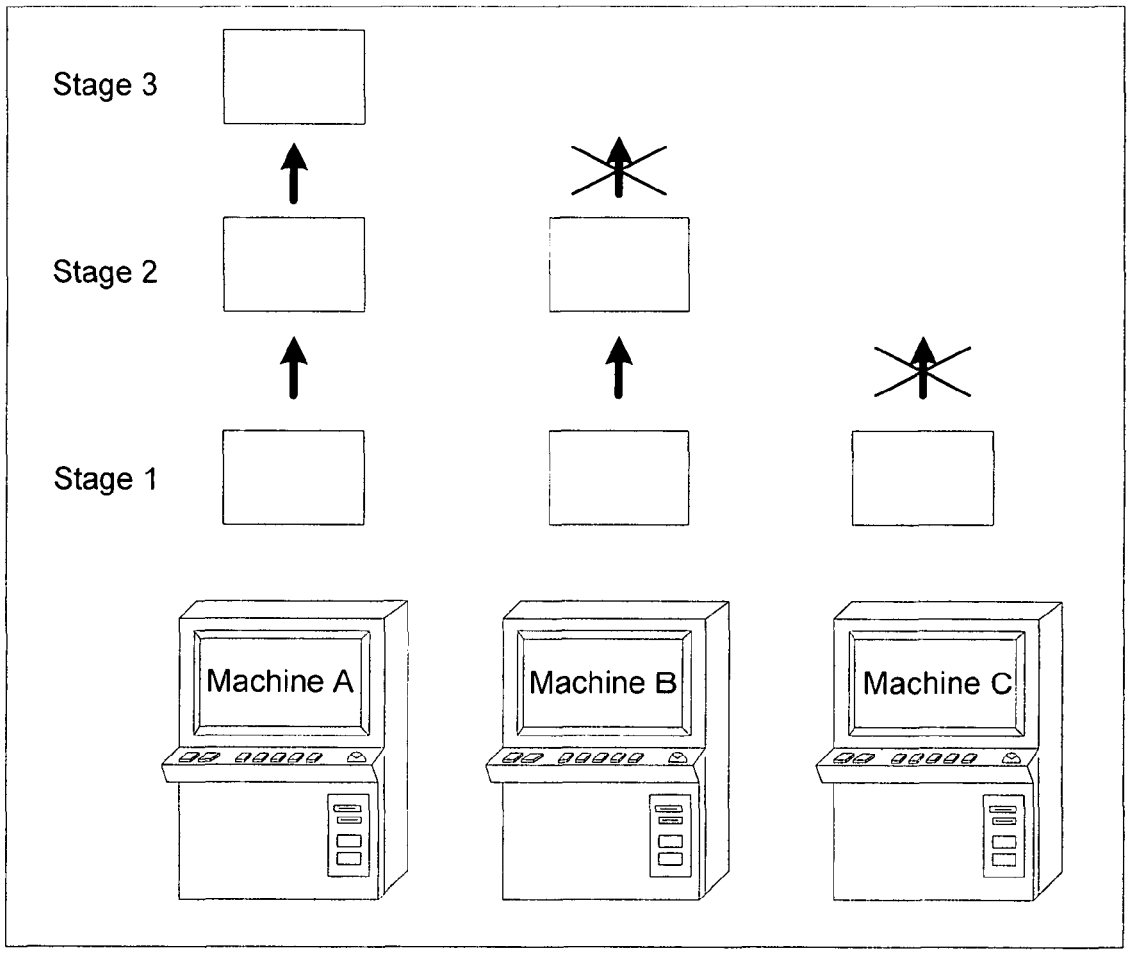
FIG. 25 shows an example of executing a plurality of bonus stages by a plurality of gaming machines.

FIG. 25 shows an example of executing a plurality of bonus stages with a plurality of gaming machines. The figure shows a gaming machine A, a gaming machine B, and a gaming machine C. The bonus stage consists of three stages. A bonus stage 1 is started on the machines A, B, and C. All the players receive the prize amount obtained by each player in the stage. In a bonus stage 2, only machines A and B are playing. Even in such a case, the machine C may obtain a prize amount in the bonus stage 2. Further, only the machine A is playing. Even in such a case, the machine B and C may receive the prize amount in the bonus stage 3.

In this way, it builds sense of supporting players who move on to the next stage among those who did not move on to the next stage, thus each player enjoys the gaming machine as a team play. And, the players who did not move onto the next stage can also obtain a prize amount of the next stage, thereby making the player feel very lucky.

Figure 26:
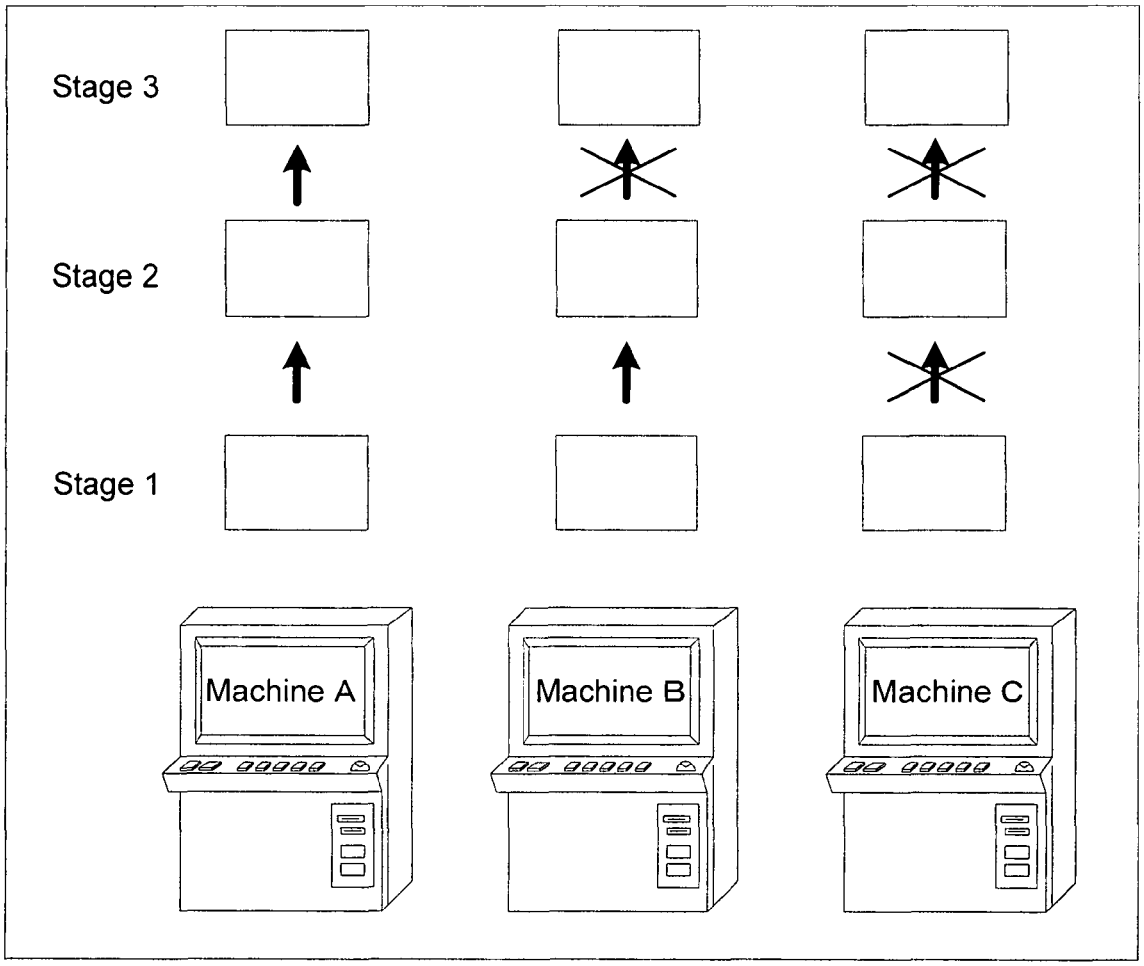
FIG. 26 shows an example of executing a plurality of bonus stages by a plurality of gaming machines.

FIG. 26 shows an example of executing a plurality of bonus stages with a plurality of gaming machines. The figure shows a gaming machine A, a gaming machine B, and a gaming machine C. The bonus stage consists of three stages. A bonus stage 1 is started on the machines A, B, and C, and the stage 1 shows the result where only the machine C may not proceed to the stage 2. Even in such case, all the machines A, B, and C may proceed to the stage 2. Also, the bonus stage 2 shows the result where the machines B and C may not proceed to the stage 3. Even in such case, all the machines A, B, and C may proceed to the bonus stage 3. The plurality of gaming machines according to the present invention may, for example, have such a style of play.

In this way, it builds a sense of supporting players who move on to the next stage among those who did not move on to next stage, thus each player enjoys the gaming machine as a team play. And, the players who did not move onto the next stage can also obtain a prize amount of the next stage, thereby making the player feel very lucky.

Figure 27:
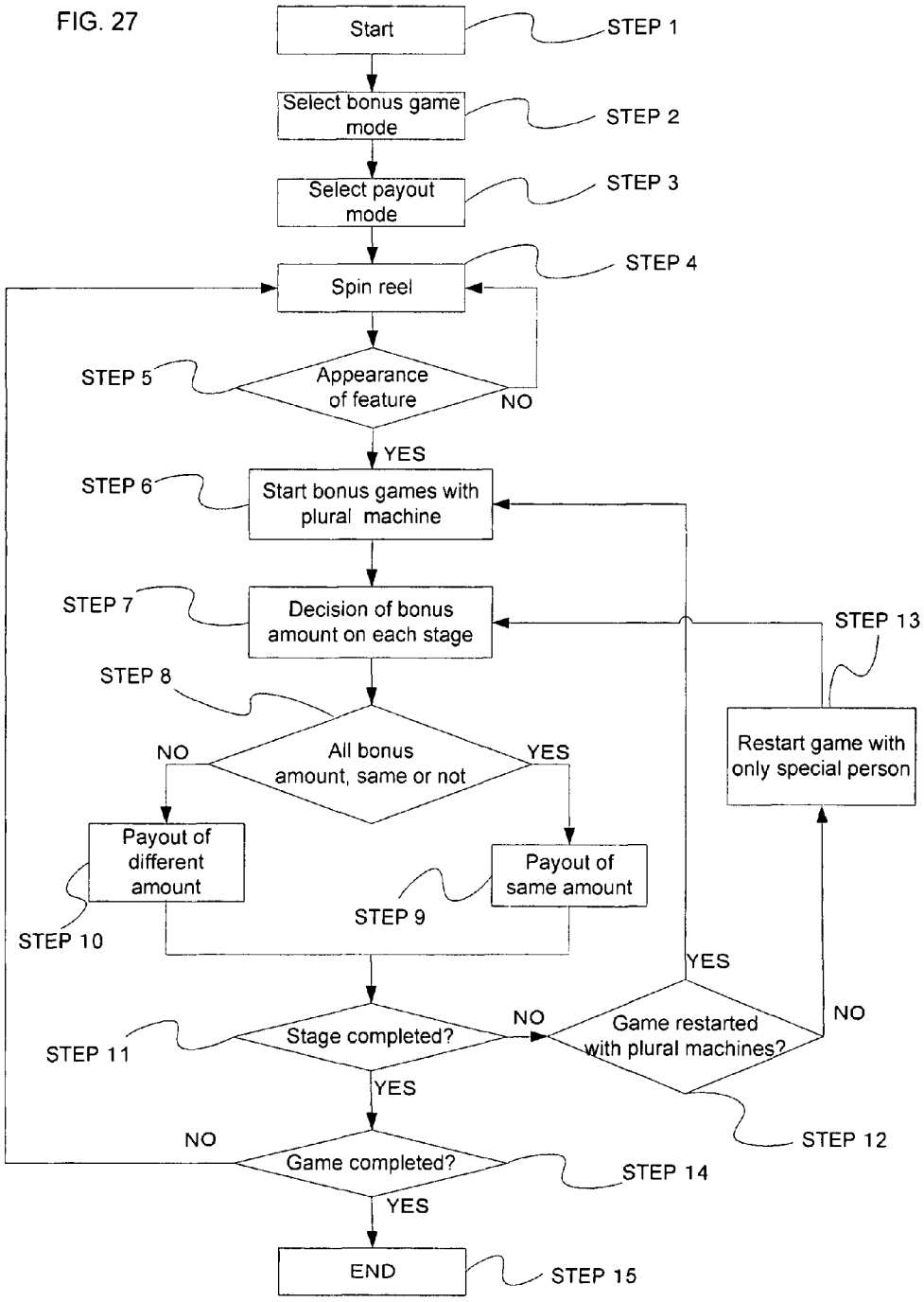
FIG. 27 shows a flow chart of a plurality of gaming machines.

FIG. 27 shows a flow chart of a plurality of gaming machine games. First, as a primary game starts (step 1), a display to select the type of bonus game played in the game is shown (step 2). The type of bonus game to be selected may be single or multiple. When the type of bonus game is selected, a selection screen of payout form is shown on the display screen (step 3). The form of payout may include, payout the same prize amount to all the players or payout a different prize amount to each player. The player chooses from these. The type of payout form may be any type.

After selecting a payout form, each mach displays a plurality of reels. And reels start to spin when each player instruct them to spin (step 4). Each player may proceed to the primary game independently. The spin stops after a predetermined time. Each player may stop the spin. When a specific feature is displayed on at least one or more of a plurality of gaming machines (step 5), the bonus game begins across the plurality of gaming machines (step 6). At this time, the bonus game may start on all the gaming machines or a specific gaming machine.

And, the prize amount obtained by the players are determined (step 7) when one stage of a bonus game is completed. Then, a determination is made as to whether the prize amount to be paid out to each player is the same or not (step 8). When the amount is determined to be the same, the same amount of prize is paid out to each player (step 9). When the amount is determined to be different, the different amount is paid out to each player (step 10). In this way, a payout may be made in each stage, or after completing all the stages. Also, the payout amount may be the same or different in each stage.

Next, a determination is made as to whether the bonus stage is completed or not (step 11). When the bonus stage is determined to be not completed, the gaming machine to restart a bonus game is determined (step 12). When the game machines to restart are determined to be the same gaming machines from the last stage, the bonus game is resumed on those gaming machines (step 6). When the gaming machines to restart are determined to be a specific machine from the gaming machine in the last stage, the bonus game resumes on the specific game machines (step 13). And the above operation is repeated (step 7 to 11).

When the bonus stage is determined to be completed, a determination is made as to whether the bonus game is completed or not (stage 14). When the bonus game is determined to be not completed, the primary game is resumed (step 4). If the bonus game is determined to be completed, the game completes (step 15).

In addition, the present invention is not limited to the above embodiments and it may be changed. For example, in the present invention, the selection of a game rule by the addition of a bet amount, the change of a payout ratio to a player by the addition of a bet amount, and the plurality of gaming machines are explained separately, however, the present invention may combine these three. Also the gaming machine according to the present invention is not limited to a slot machine, and it may be any type of gaming machine as long as it has a feature. For example, it may be anything, for example, a gaming machine to play a card game, or a gaming machine to play a reel game. Also, the gaming machine according to the present invention allows a player to change a bet amount, that is, it may be increased, or decreased.

What is claimed is:

1. A gaming system comprising:

a plurality of gaming machines electrically connected to each other, each gaming machine including a display screen or a physical reel mechanism, a primary game and a bonus game as a single game session;

wherein the gaming machine has at least one bonus game, and a player can change a bet amount at any time during the course of the bonus game in the single game session, wherein a payout ratio of the bonus game to a player changes according to a change of the bet amount; and wherein when one of the plurality of gaming machines wins the bonus game, a different or same bonus amount is paid out to a part or all of the plurality of gaming machines.

2. The gaming system according to claim 1, wherein at least one rule of the bonus game changes according to a change of the bet amount.

3. The gaming system according to claim 1, wherein the bonus game includes a pay table, and the pay table changes according to a change of the bet amount.

4. The gaming system according to claim 1, wherein the bonus game has at least one progressive game, and a chance for the player to win the progressive game changes according to a change of the bet amount.

* * * * *